US011588269B2

(12) United States Patent
Imamura et al.

(10) Patent No.: US 11,588,269 B2
(45) Date of Patent: Feb. 21, 2023

(54) CONNECTOR

(71) Applicant: Yazaki Corporation, Tokyo (JP)

(72) Inventors: Masaki Imamura, Makinohara (JP); Kazuhide Ikeya, Makinohara (JP); Hiroshi Miyazaki, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 72 days.

(21) Appl. No.: 17/237,708

(22) Filed: Apr. 22, 2021

(65) Prior Publication Data

US 2021/0336372 A1 Oct. 28, 2021

(30) Foreign Application Priority Data

Apr. 24, 2020 (JP) ..... JP2020-077374

(51) Int. Cl.
*H01R 13/514* (2006.01)
*H01R 13/627* (2006.01)

(52) U.S. Cl.
CPC ..... *H01R 13/514* (2013.01); *H01R 13/6272* (2013.01)

(58) Field of Classification Search
CPC . H01R 9/2408; H01R 13/514; H01R 13/6272
USPC ..... 439/717
See application file for complete search history.

(56) References Cited

U.S. PATENT DOCUMENTS 6,361,355 B1 * 3/2002 Matsuoka ..... H01R 9/2408 439/701
6,413,118 B2 * 7/2002 Fukatsu ..... H01R 13/514 439/717
2013/0082048 A1 * 4/2013 Hirasawa ..... B60R 16/0238 220/3.9
2015/0364270 A1 * 12/2015 Kawamura ..... H01R 9/2416 174/520
2019/0348824 A1 * 11/2019 Ikeda ..... H01R 9/2408

FOREIGN PATENT DOCUMENTS

JP 5-31141 U 4/1993
JP 2009-295423 A 12/2009

* cited by examiner

*Primary Examiner* — Gary F Paumen
(74) *Attorney, Agent, or Firm* — Sughrue Mion, PLLC

(57) ABSTRACT

A connector includes a first connector housing including a first wall. The first connector housing is attachable to a second connector housing such that the first wall opposes a second wall of the second connector housing. The first connector housing includes: a fitting chamber defined at least by the first wall, the fitting chamber allowing a counterpart connector housing to be fitted therein; and an engaging arm provided on the first wall, the engaging arm being configured to engage an engaged arm provided on the second wall of the second connector housing when the first connector housing is completely attached to the second connector housing. The engaging arm serves as an attachment state detection mechanism configured to detect an incomplete attachment state in which the first connector housing is incompletely attached to the second connector housing.

5 Claims, 26 Drawing Sheets

CONNECTOR

CROSS-REFERENCE TO RELATED APPLICATIONS

This application claims the benefit of priority of Japanese Patent Application No. 2020-077374 filed on Apr. 24, 2020, the entire contents of which are incorporated herein by reference.

FIELD

The present disclosure relates to a connector.

BACKGROUND

As a connector used in a state in which a plurality of connector housings are stacked and attached to each other (the connecter is also referred to as a "combined connector"), for example, a technique disclosed in JP-A-2009-295423 is known. A combined connector shown in FIGS. 1 to 3 of JP-A-2009-295423 includes two connector housings. Upper surfaces of the connector housings are formed as mating surfaces when other connector housings are stacked.

Locking protrusions are provided on both side surfaces of each of the connector housings. In addition, elastic engagement pieces formed so as to be engageable with the locking protrusions are provided on both side portions of each of the mating surfaces of the connector housings.

The connector housings stacked in an upper-lower direction are coupled to each other by engagement between the locking protrusion of one connector housing and the elastic engagement piece of the other connector housing. More specifically, a rear end side of the mating surface of the other connector housing is overlapped with a front end side of the mating surface of one connector housing. Thereafter, the connector housings slide relative to each other along the mating surface, whereby the locking protrusion and the elastic engagement piece are engaged with each other.

SUMMARY

In the above-described related art, there is no means for detecting a state in which the locking protrusion and the elastic engagement piece are not appropriately engaged, that is, a state in which the connector housings are incompletely attached to each other (hereinafter, this state is referred to as an "incomplete attachment state").

As described above, in the related art, there is no means for detecting the incomplete attachment state, and thus the stacked connector housings may be mounted on a vehicle without noticing that they are in the incomplete attachment state. In this way, in the related art, when the connector housings in the incomplete attachment state are mounted on the vehicle, the connector housings may be separated due to influence of vibration or the like that occurs during traveling of the vehicle.

The present disclosure has been made in view of the above circumstances, and an object thereof is to provide a connector capable of preventing an incomplete attachment state as a result of attachment of connector housings to each other.

The present disclosure provides a connector including: a first connector housing including a first wall, the first connector housing being attachable to a second connector housing such that the first wall opposes a second wall of the second connector housing, wherein the first connector housing includes: a fitting chamber defined at least by the first wall, the fitting chamber allowing a counterpart connector housing to be fitted therein; and an engaging arm provided on the first wall, the engaging arm being configured to engage an engaged arm provided on the second wall of the second connector housing when the first connector housing is completely attached to the second connector housing, and wherein the engaging arm serves as an attachment state detection mechanism configured to detect an incomplete attachment state in which the first connector housing is incompletely attached to the second connector housing.

According to the present disclosure, the insertion of the counterpart connector housing up to the fitting completion position of the connector housing and the counterpart connector housing is restricted even when the counterpart connector housing is inserted into the fitting chamber in the incomplete attachment state, so that it can be detected that the connector housings are in the incomplete attachment state. Therefore, according to the present disclosure, the incomplete attachment state when attaching the connector housings to each other can be prevented.

DETAILED DESCRIPTION

Hereinafter, a connector according to a first embodiment of the present disclosure will be described with reference to FIGS. 1 to 14, and a connector according to a second embodiment of the present disclosure will be described with reference to FIGS. 15 to 26.

First Embodiment

Figure 1:
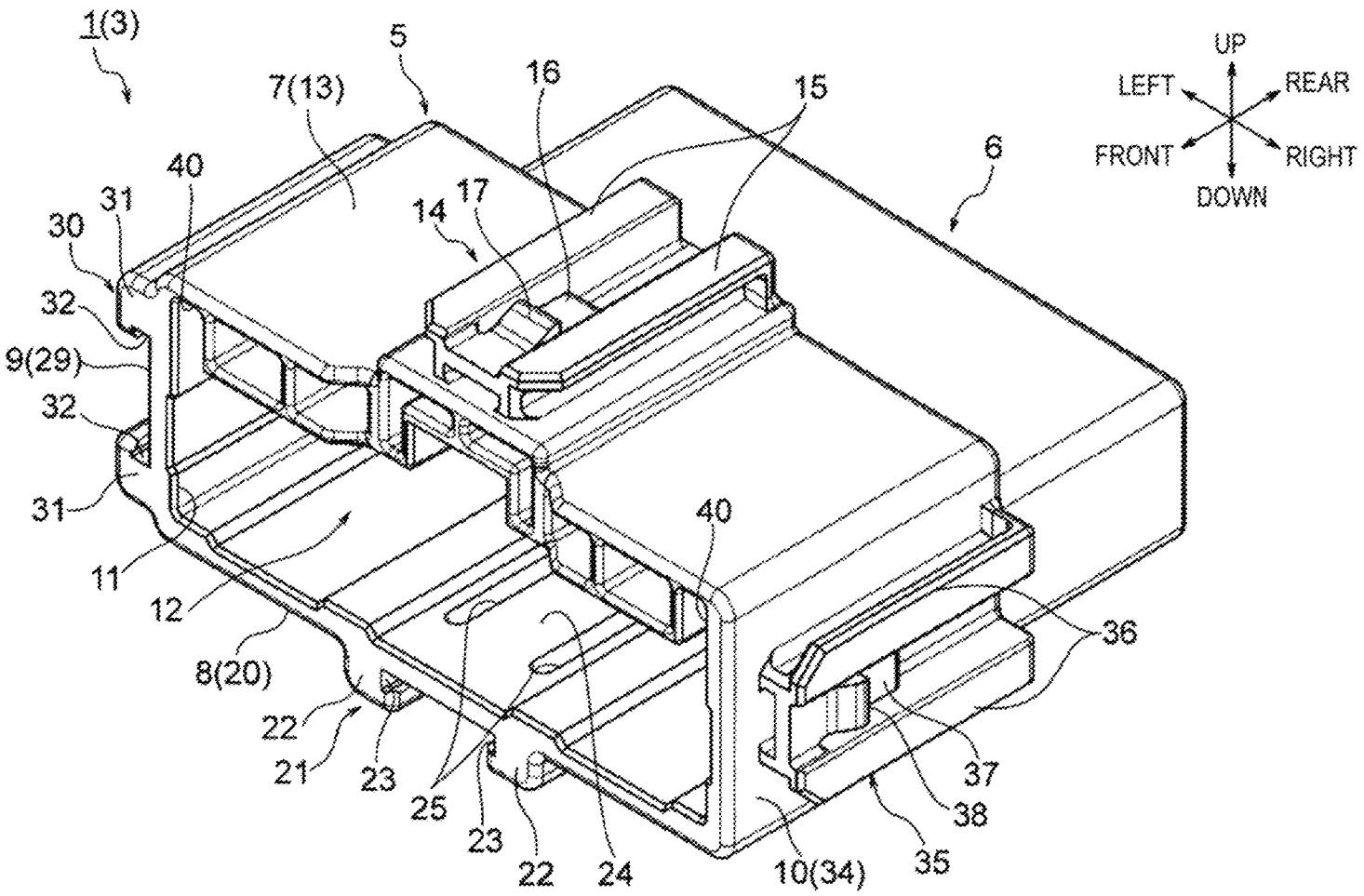
FIG. 1 is a perspective view showing a connector according to a first embodiment of the present disclosure.
Figure 2:
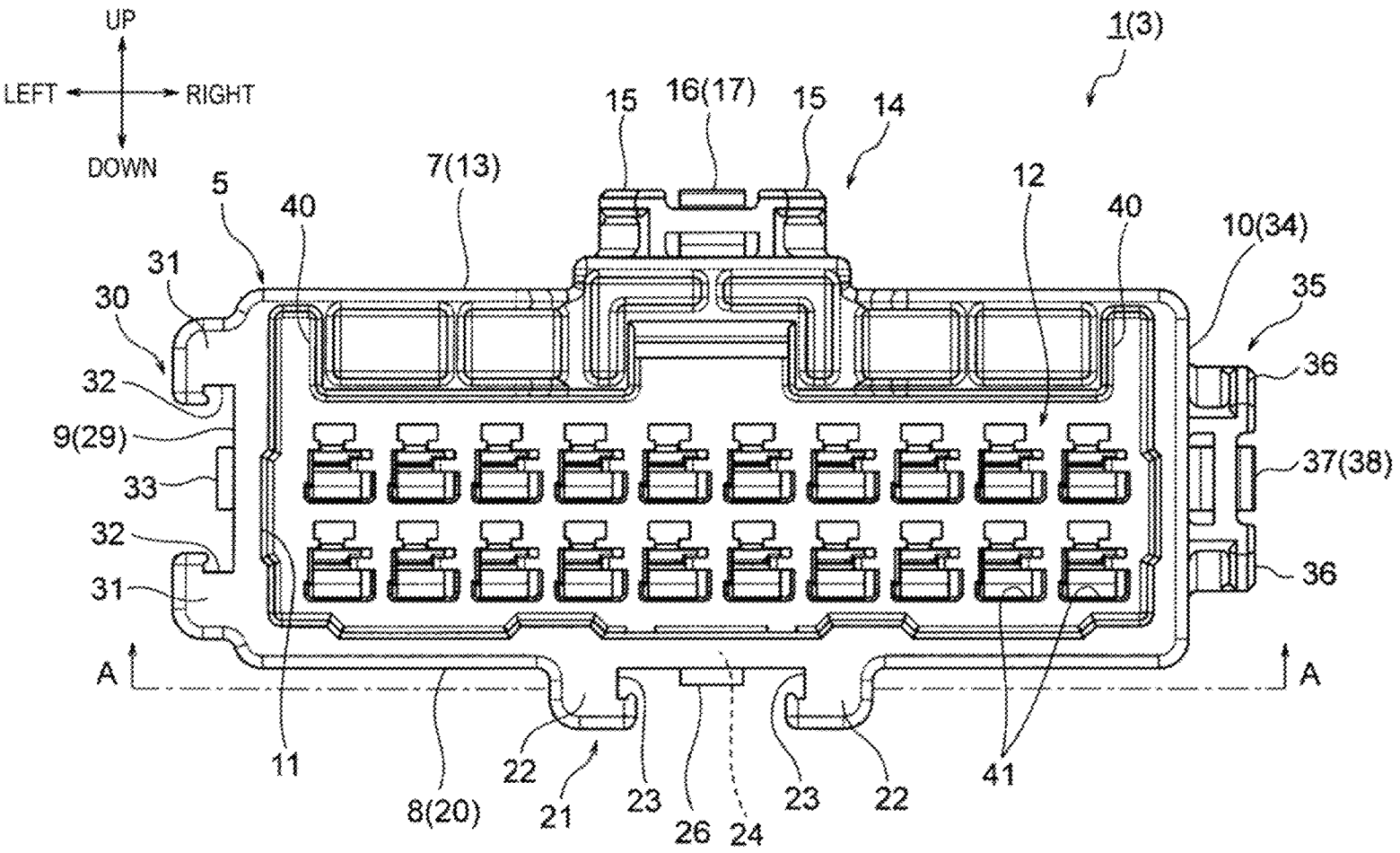
FIG. 2 is a front view of the connector (a connector housing) shown in FIG. 1.
Figure 3:
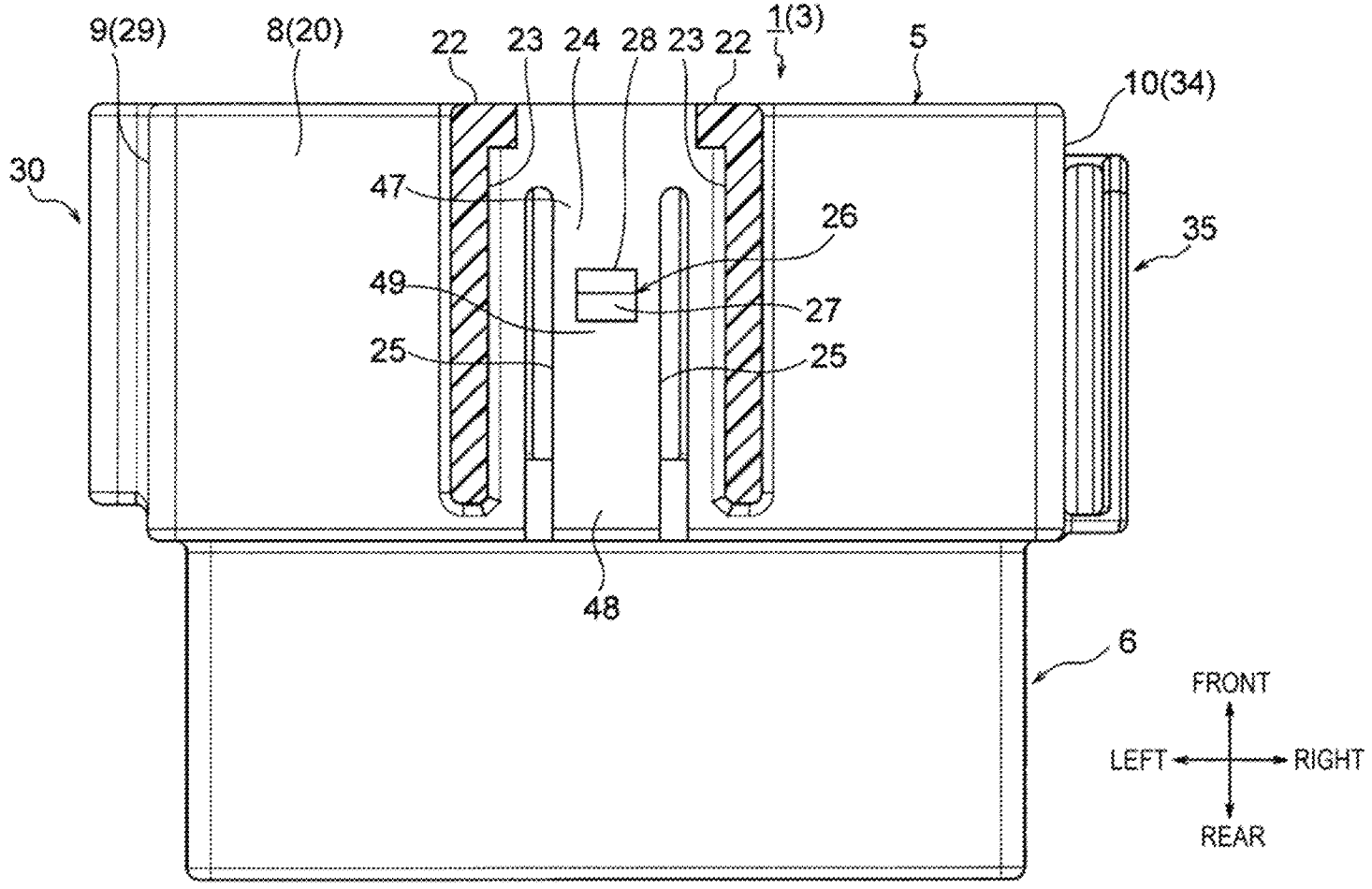
FIG. 3 is a plan view of the connector (the connector housing) in FIG. 2 as viewed from a lower surface side, and is a view taken along a line A-A in FIG. 2.
Figure 4:
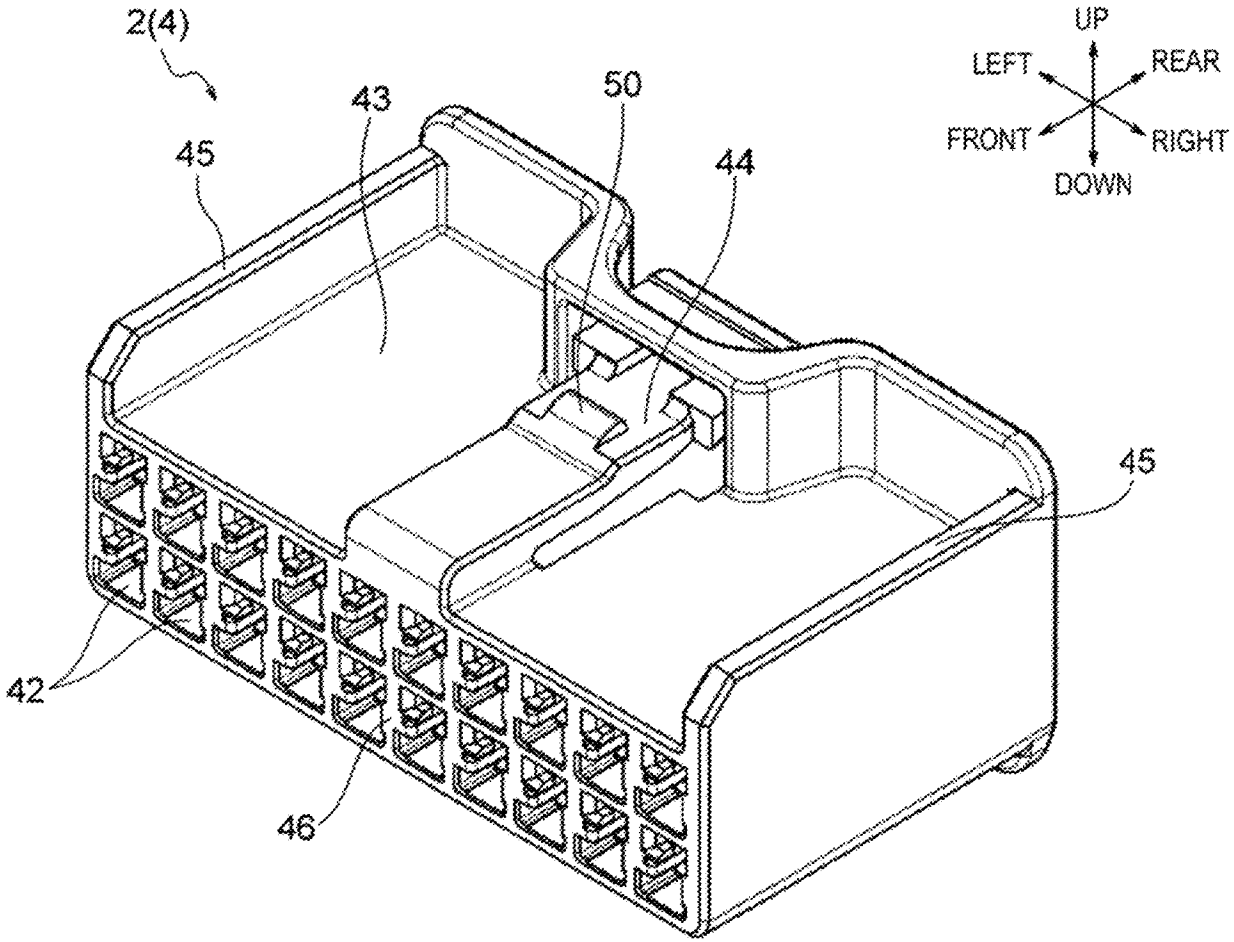
FIG. 4 is a perspective view of a counterpart connector (a counterpart connector housing).
Figure 5:
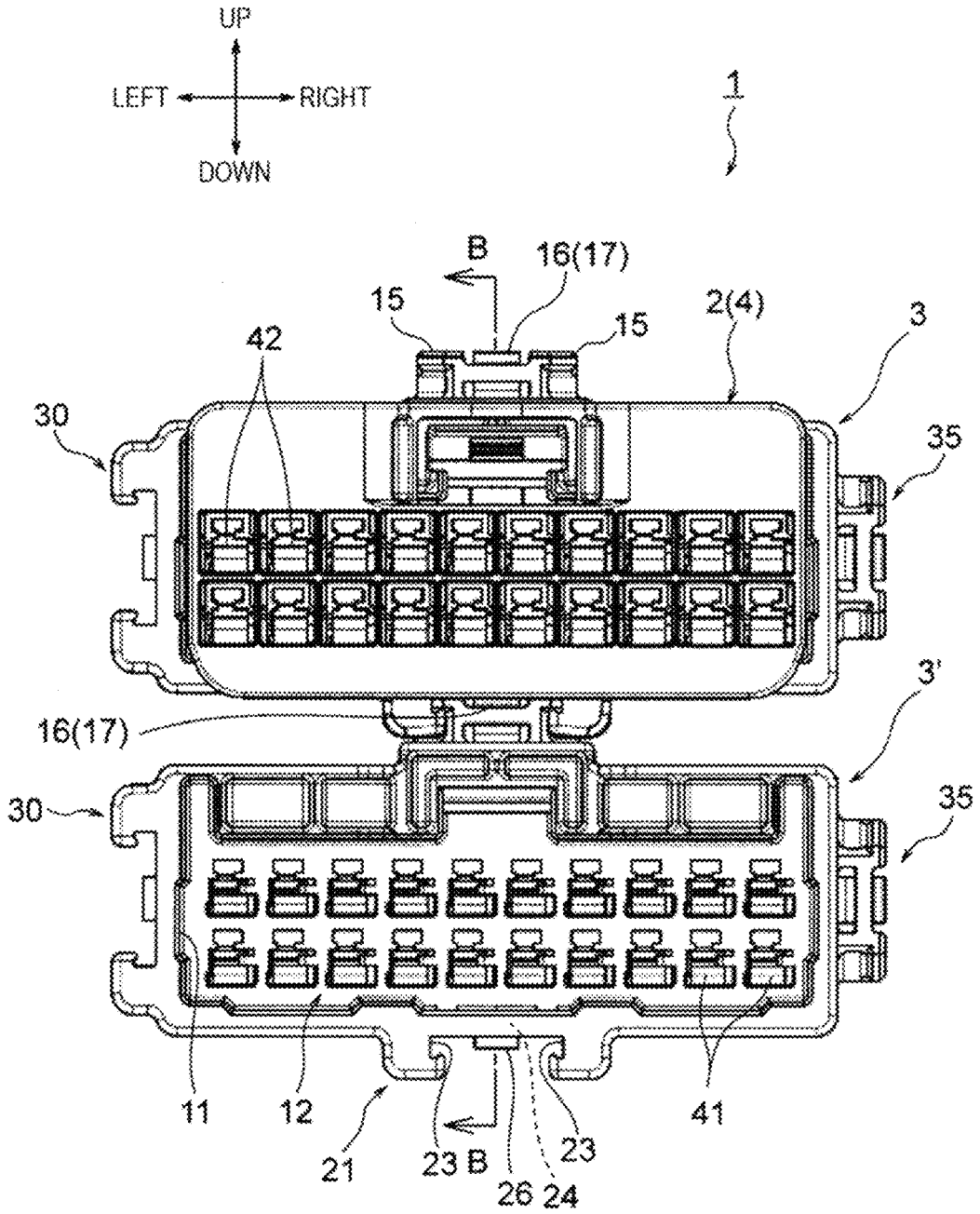
FIG. 5 is a front view showing a state in which the connector housings are attached to each other and one connector housing and the counterpart connector housing are fitted to each other.
Figure 6:
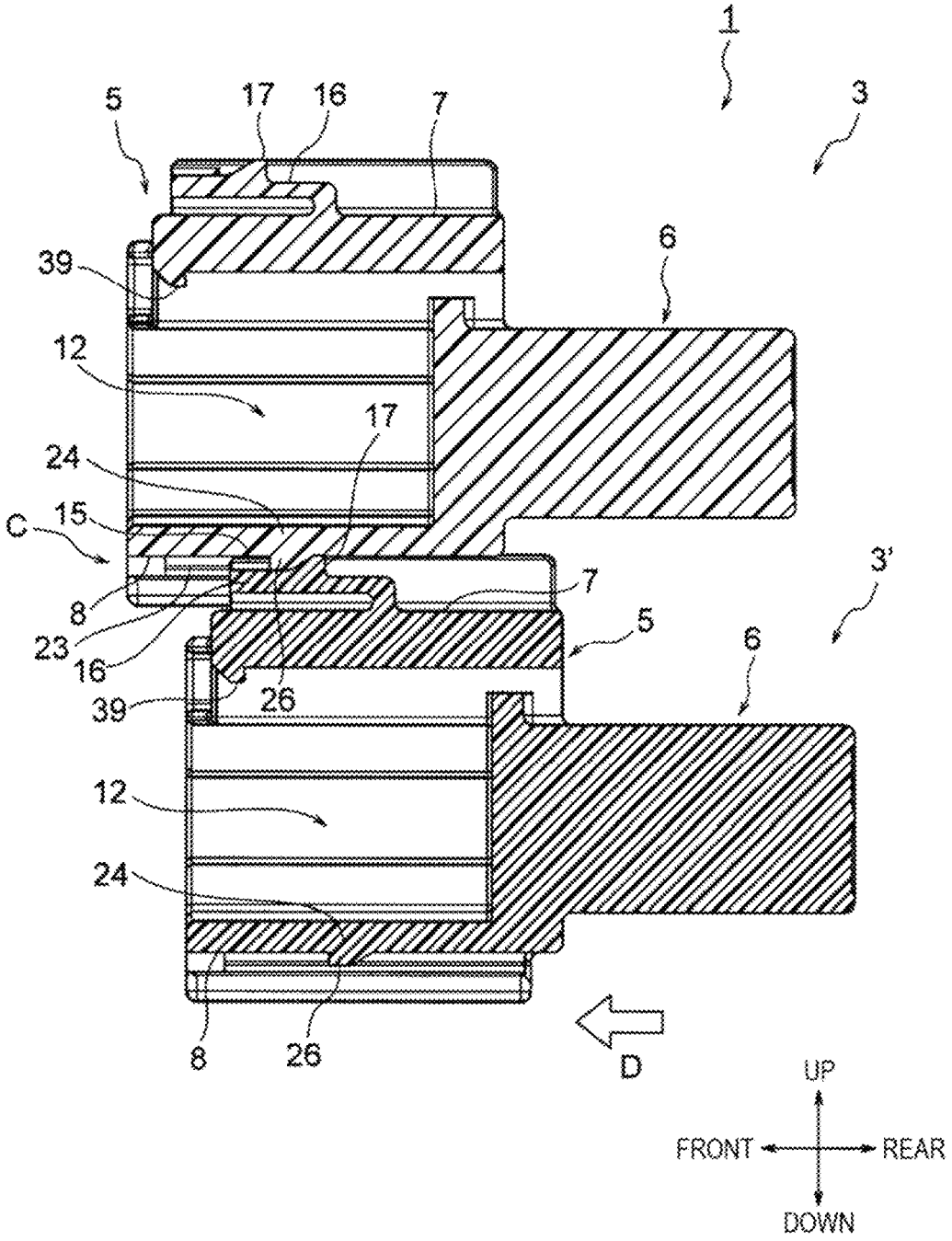
FIG. 6 is a cross-sectional view showing a state before the connector housings are attached to each other and before one connector housing and the counterpart connector housing are fitted to each other as taken along a line B-B in FIG. 5.
Figure 7:
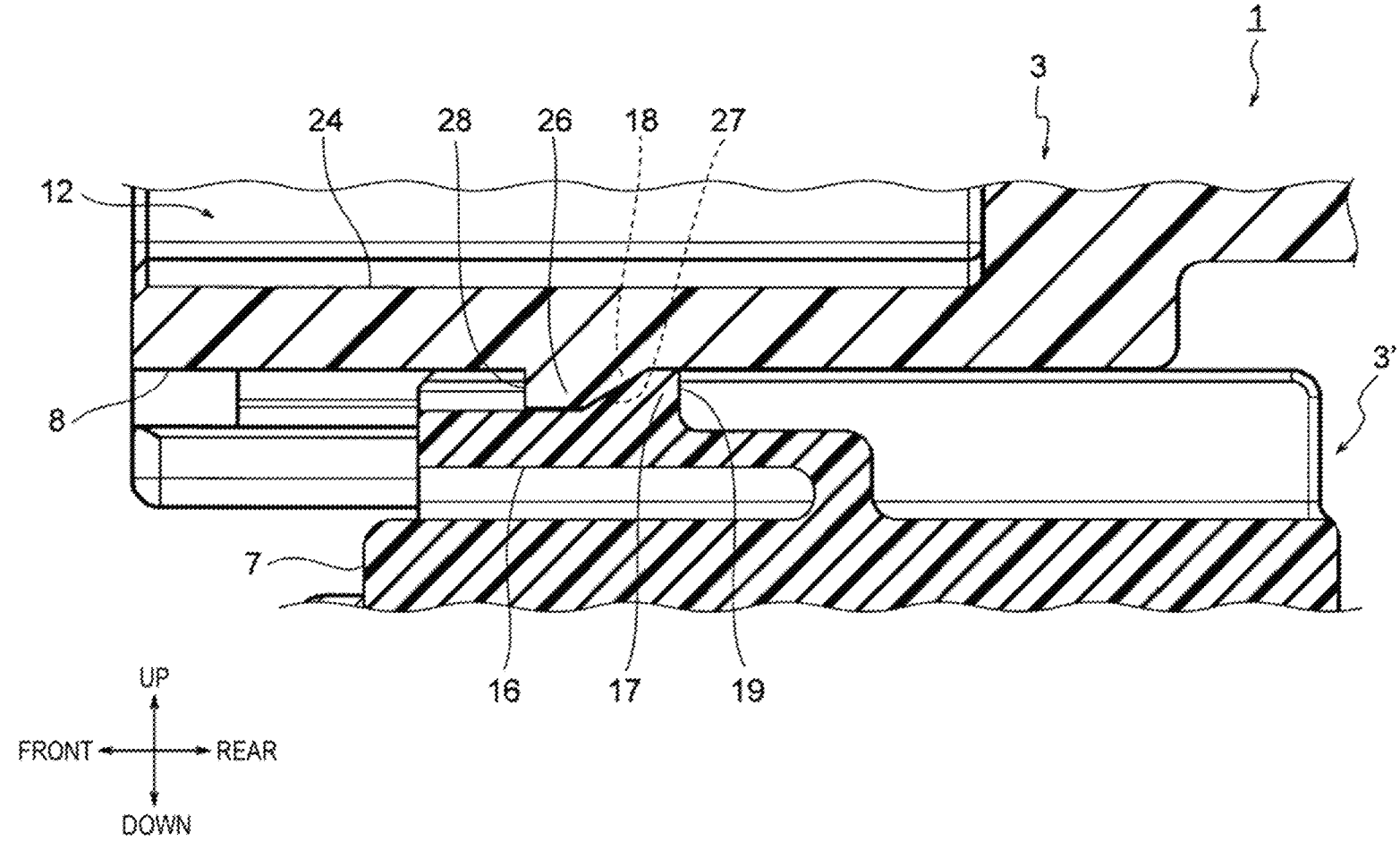
FIG. 7 is an enlarged cross-sectional view of a portion indicated by an arrow C in FIG. 6.
Figure 8:
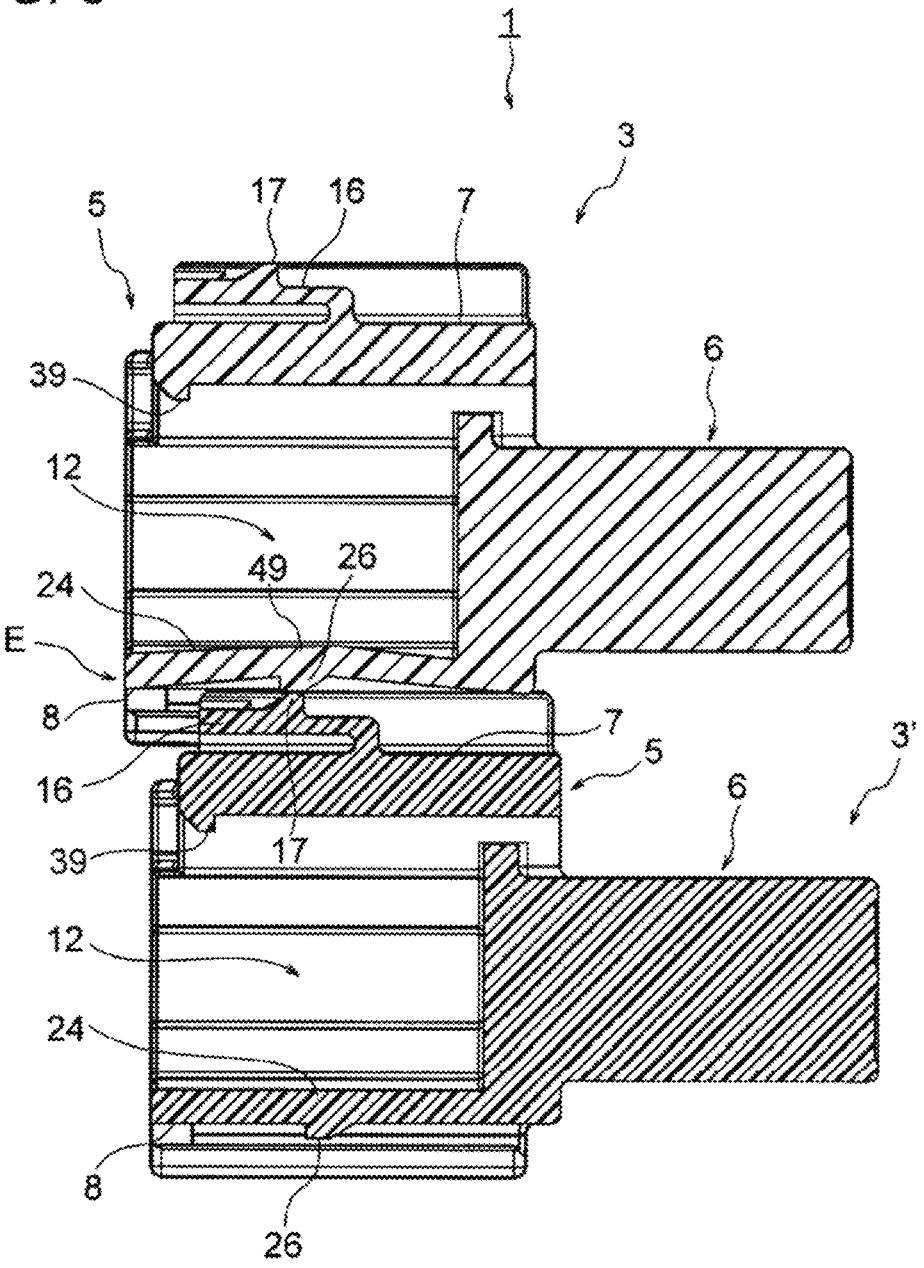
FIG. 8 is a view following FIG. 6, and is a cross-sectional view showing an incomplete attachment state of the connector housings.
Figure 9:
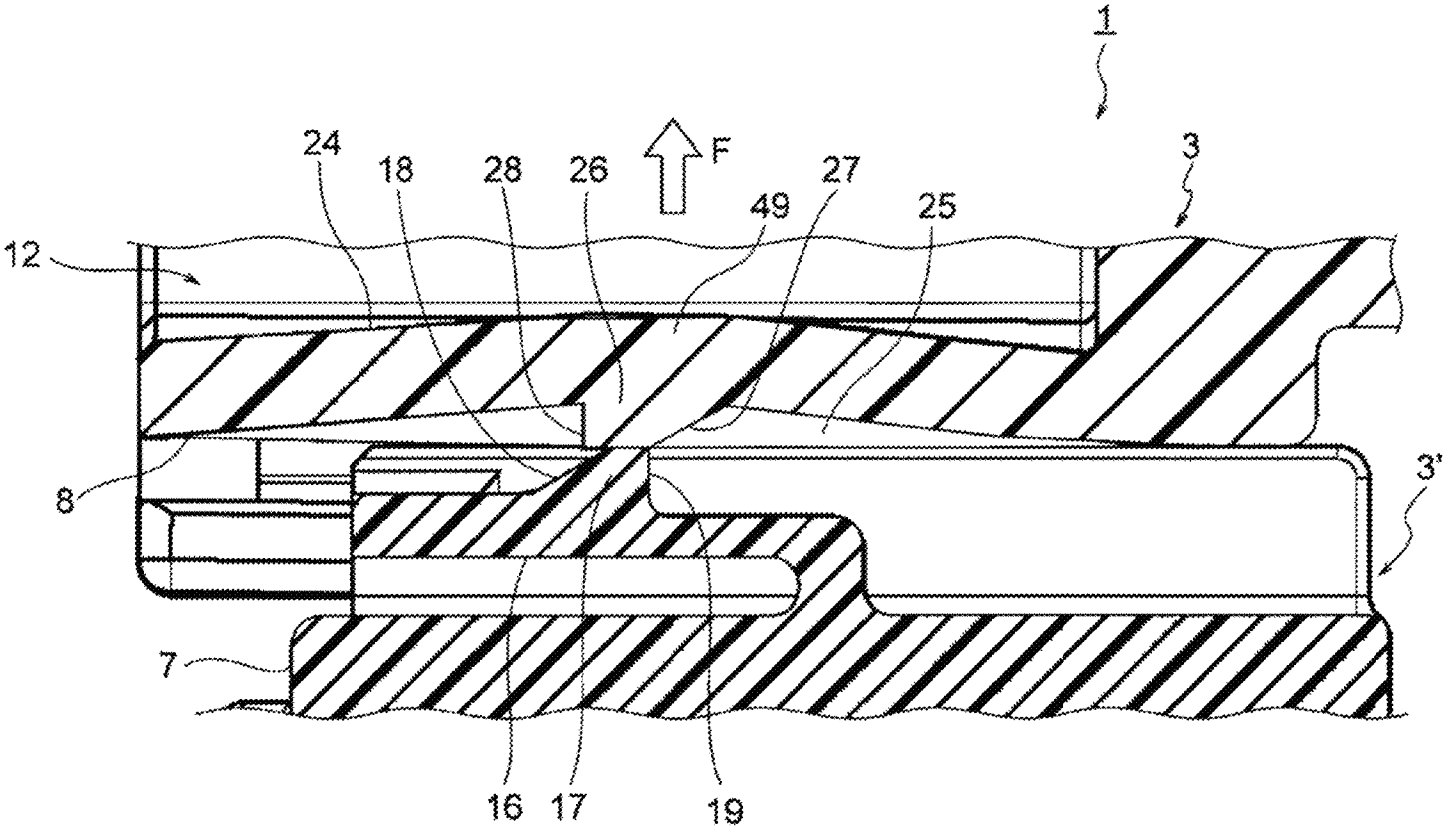
FIG. 9 is an enlarged cross-sectional view of a portion indicated by an arrow E in FIG. 8.
Figure 10:
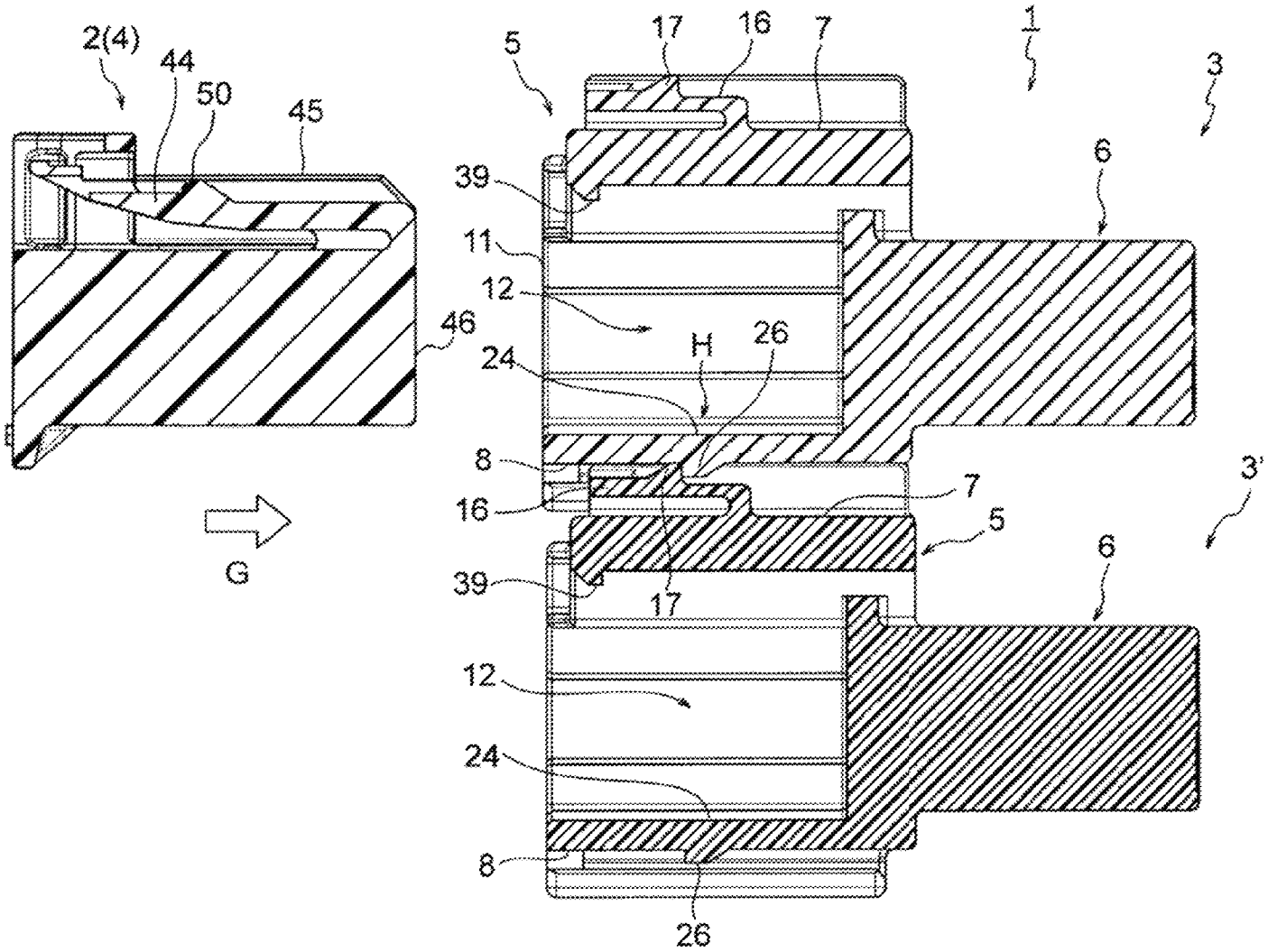
FIG. 10 is a view following FIG. 8, and is a cross-sectional view showing a state in which the connector housings are attached to each other and a cross-sectional view of the counterpart connector housing.
Figure 11:
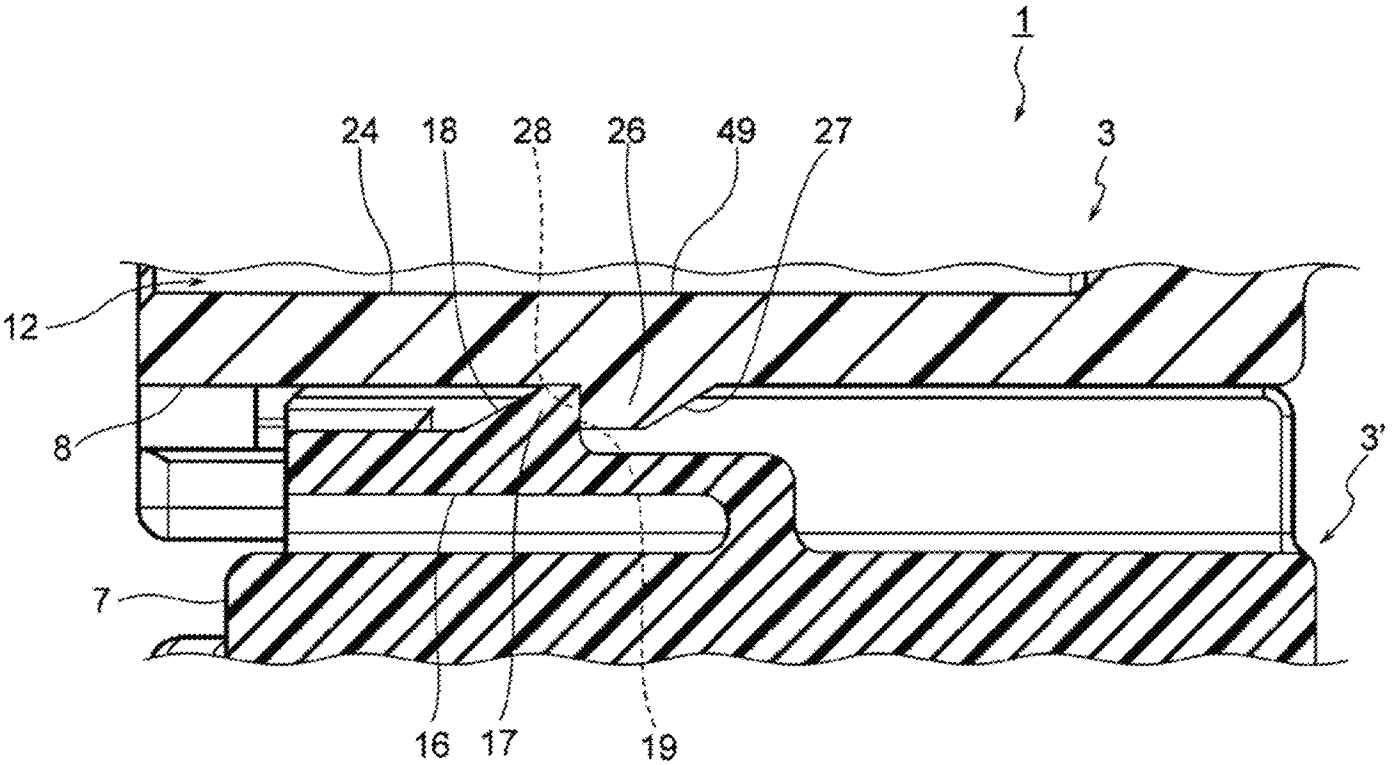
FIG. 11 is an enlarged cross-sectional view of a portion indicated by an arrow H in FIG. 10.
Figure 12:
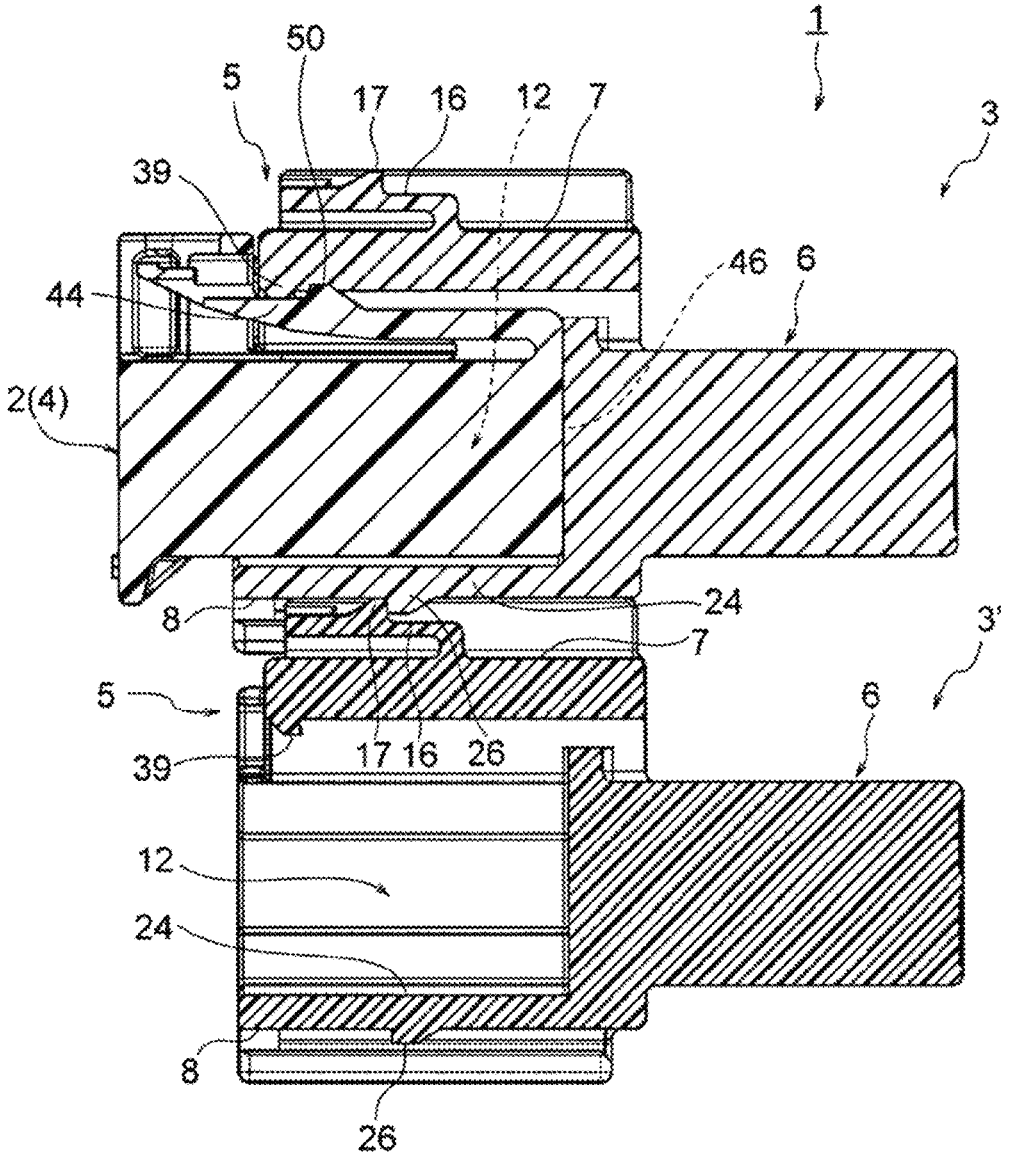
FIG. 12 is a view following FIG. 10, and is a cross-sectional view showing a state in which one connector housing and the counterpart connector housing are fitted to each other in the state in which the connector housings are attached to each other.
Figure 13:
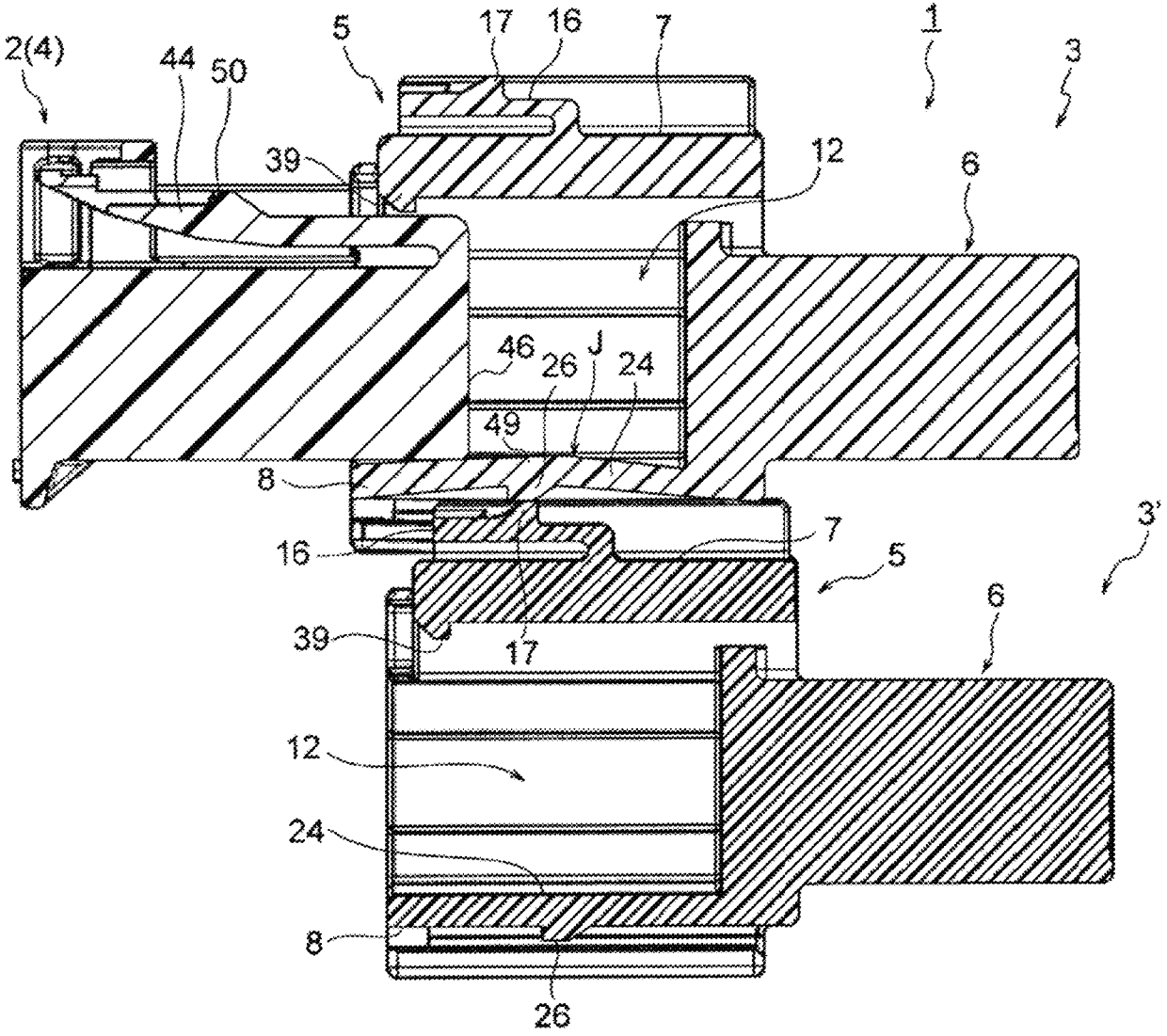
FIG. 13 is a cross-sectional view showing a state in which the counterpart connector housing is started to be inserted into a fitting chamber of one connector housing in the incomplete attachment state of the connector housings.
Figure 14:
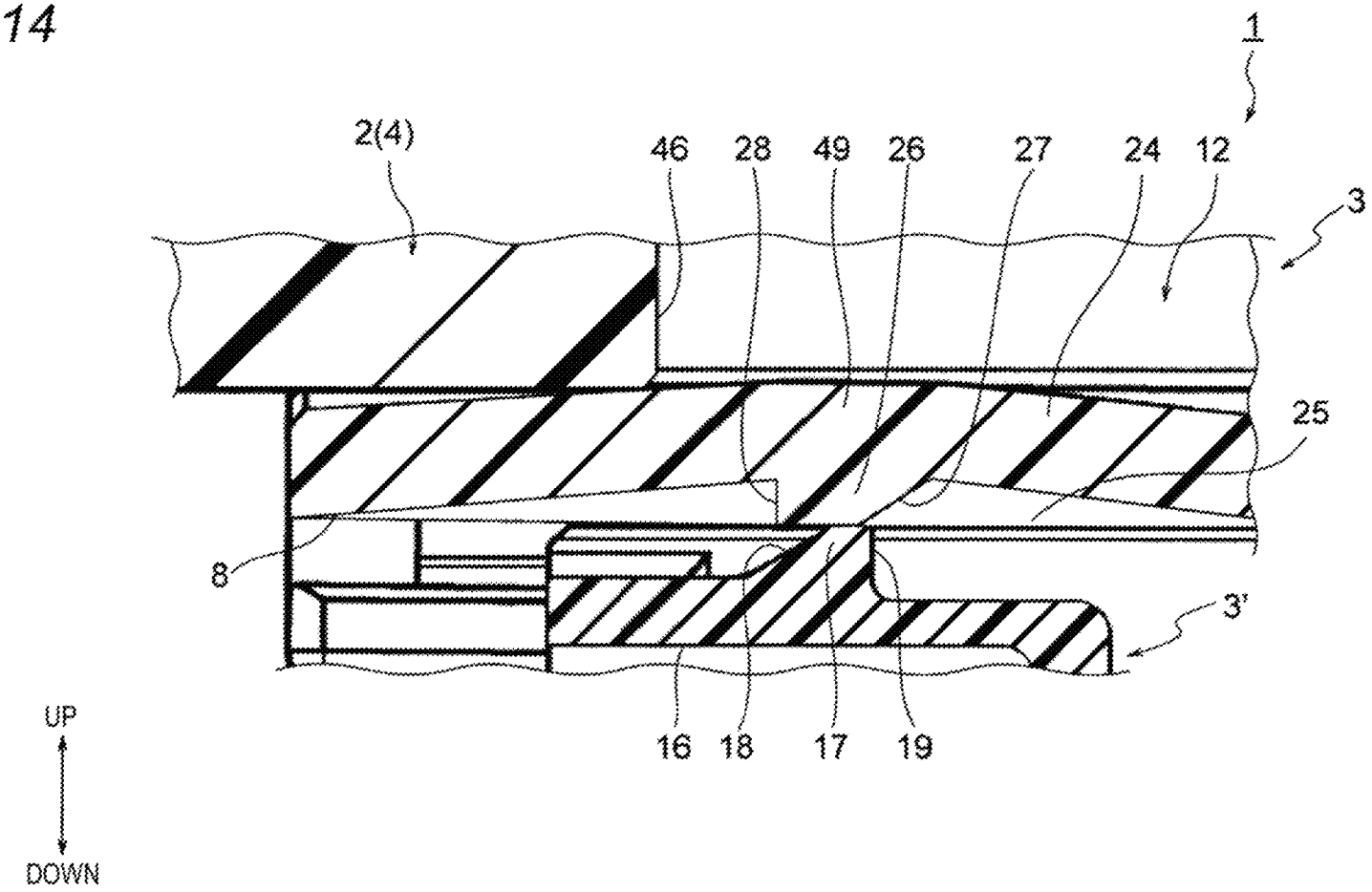
FIG. 14 is an enlarged cross-sectional view of a portion indicated by an arrow J in FIG. 13.

FIG. 1 is a perspective view showing a connector according to a first embodiment of the present disclosure; FIG. 2 is a front view of the connector (a connector housing) shown in FIG. 1; FIG. 3 is a plan view of the connector (the connector housing) in FIG. 2 as viewed from a lower surface side, and is a view taken along a line A-A in FIG. 2; FIG. 4 is a perspective view of a counterpart connector (a counterpart connector housing); FIG. 5 is a front view showing a state in which the connector housings are attached to each other and one connector housing and the counterpart connector housing are fitted to each other; FIG. 6 is a cross-sectional view showing a state before the connector housings are attached to each other and before one connector housing and the counterpart connector housing are fitted to each other as taken along a line B-B in FIG. 5; FIG. 7 is an enlarged cross-sectional view of a portion indicated by an arrow C in FIG. 6; FIG. 8 is a view following FIG. 6, and is a cross-sectional view showing an incomplete attachment state of the connector housings; FIG. 9 is an enlarged cross-sectional view of a portion indicated by an arrow E in FIG. 8; FIG. 10 is a view following FIG. 8, and is a cross-sectional view showing a state in which the connector housings are attached to each other and a cross-sectional view of the counterpart connector housing; FIG. 11 is an enlarged cross-sectional view of a portion indicated by an arrow H in FIG. 10; FIG. 12 is a view following FIG. 10, and is a cross-sectional view showing a state in which one connector housing and the counterpart connector housing are fitted to each other in the state in which the connector housings are attached to each other; FIG. 13 is a cross-sectional view showing a state in which the counterpart connector housing is started to be inserted into a fitting chamber of one connector housing in the incomplete attachment state of the connector housings; and FIG. 14 is an enlarged cross-sectional view of a portion indicated by an arrow J in FIG. 13. Arrows in the drawings respectively indicate a front-rear direction, an upper-lower direction and a left-right direction (directions of the arrows are examples).

In FIGS. 1 to 3 and 5, a reference numeral 1 indicates a connector according to the embodiment of the present disclosure. The connector 1 is also called a "combined connector". As will be described in detail later, the connector 1 is used in a state in which a plurality of connector housings are stacked and attached (connected) to each other, and a counterpart connector 2 (a counterpart connector housing 4) is fitted thereto (see FIGS. 5 and 12).

In the present embodiment, as shown in FIG. 5, the connector 1 is used in a state in which a connector housing 3 and a connector housing 3' are stacked and attached to each other. In the present embodiment, the two connector housings are used in a state of being stacked and attached to each other, but the present disclosure is not limited thereto, and three or more connector housings may be used in a state of being stacked and attached to each other.

Here, the connector housing 3 serves as an example of a "first connector housing."The connector housing 3' serves as an example of a "second connector housing."

The connector 1 includes the connector housing 3 (see FIGS. 1 to 3), the connector housing 3' (see FIG. 5) and a terminal-attached electric wire (not shown). The connector housing 3 and the connector housing 3' have the same configuration and structure. Therefore, in the present embodiment, detailed description of the connector housing 3' will be omitted. The counterpart connector 2 includes the counterpart connector housing 4 (see FIG. 4) and a terminal-attached electric wire (not shown). Hereinafter, the configuration of the connector housing 3 will be described, and a configuration of the counterpart connector housing 4 will be described.

The terminal-attached electric wire provided in each of the connector 1 and the counterpart connector 2 is formed by connecting a terminal to an end of the electric wire, and known one may be adopted. Therefore, detailed description of the terminal-attached electric wire provided in each of the connector 1 and the counterpart connector 2 will be omitted.

First, the connector housing 3 will be described. The connector housing 3 shown in FIGS. 1 to 3 is formed of an insulating synthetic resin material, and is formed in a block shape elongated in the left-right direction and extending in the front-rear direction. The connector housing 3 includes a connector fitting portion 5 and a terminal accommodating portion 6.

The connector fitting portion 5 shown in FIGS. 1 and 2 is formed as a portion to which the counterpart connector 2 (see FIG. 4) is fitted. As shown in FIGS. 1 and 2, the connector fitting portion 5 has an upper wall 7, a bottom wall 8, a left side wall 9, and a right side wall 10. A front surface is formed into an opening as an insertion port 11, and a fitting chamber 12 is provided inside so as to communicate with the insertion port 11.

The upper wall 7 shown in FIGS. 1 and 2 is provided with an engaged portion 14 at an intermediate portion of an upper surface 13 in the left-right direction. As shown in FIGS. 1 and 2, the engaged portion 14 is formed so as to protrude upward from the upper surface 13, and is formed so as to extend from a front end to a rear end of the upper surface 13 along an axial direction of the connector housing 3 (the front-rear direction in FIG. 1). As shown in FIG. 1, the engaged portion 14 includes a pair of guide portions 15 and an engaged arm 16.

As shown in FIG. 2, each of the pair of guide portions 15 is formed in a substantially hook shape in the front view. As shown in FIG. 1, the pair of guide portions 15 are formed so as to extend from the front end to the rear end of the upper surface 13 along the axial direction of the connector housing 3 (the front-rear direction in FIG. 1) at a predetermined interval in the left-right direction.

As shown in FIG. 1, the engaged arm 16 is formed in an arm shape (a tongue shape). As shown in FIG. 1, the engaged arm 16 is disposed between the pair of guide portions 15 and on a front end side of the upper wall 7, and is formed so as to extend along the axial direction of the connector housing 3 (the front-rear direction in FIG. 1).

As shown in FIG. 1, the engaged arm 16 is provided with an engaged protrusion 17 protruding upward at an intermediate portion thereof in an extending direction. The engaged protrusion 17 includes a tapered surface 18 and an engaged surface 19 (see FIG. 7). As shown in FIG. 7, the tapered surface 18 is formed so as to be inclined such that a height in the upper-lower direction gradually increases from the front end side to a rear end side of the upper wall 7. As shown in FIG. 7, the engaged surface 19 is formed so as to be substantially orthogonal to the upper wall 7.

The bottom wall 8 shown in FIGS. 1 and 2 is provided with an engaging portion 21 at an intermediate portion of a lower surface 20 in the left-right direction. As shown in FIGS. 1 and 2, the engaging portion 21 is formed so as to protrude downward from the lower surface 20, and is formed so as to extend from a front end to a rear end of the bottom wall 8 (an example of a "first wall") along the axial direction of the connector housing 3 (the front-rear direction in FIG. 1). As shown in FIG. 1, the engaging portion 21 includes a pair of wall portions 22, a pair of guide grooves 23 and an engaging arm 24.

As shown in FIGS. 1 and 2, the pair of wall portions 22 are formed so as to protrude downward from the lower surface 20, and are formed so as to extend from the front end to the rear end of the lower surface 20 along the axial direction of the connector housing 3 (the front-rear direction in FIG. 1) at a predetermined interval in the left-right direction.

The pair of guide grooves 23 are formed such that the pair of guide portions 15 of the engaged portion 14 provided on the upper wall 7 (an example of a "second wall") of the connector housing 3' (see FIG. 5) can be fitted and slidable. As shown in FIGS. 1 and 2, each of the pair of guide grooves 23 is formed inside the wall portion 22 in a recessed shape in the front view.

As shown in FIGS. 1 and 3, the engaging arm 24 is formed in an arm shape (a bridge shape). As shown in FIG. 3, the engaging arm 24 is formed between the pair of wall portions 22 and extends from a front end side to a rear end side of the bottom wall 8 along the axial direction of the connector housing 3 (the front-rear direction in FIG. 3).

More specifically, as shown in FIG. 3, the engaging arm 24 is formed by providing a pair of slits 25 in the bottom wall 8. The pair of slits 25 are formed between the pair of wall portions 22 so as to extend from the front end side to the rear end side of the bottom wall 8 along the axial direction of the connector housing 3 (the front-rear direction in FIG. 3) at a predetermined interval in the left-right direction. As shown in FIG. 3, the engaging arm 24 is integrally formed with the bottom wall 8, and one end 47 (an example of a "first end") and the other end 48 (an example of a "second end") thereof in an extending direction are formed continuously with the bottom wall 8. That is, the engaging arm 24 is provided in the bottom wall 8 while being supported at both ends thereof.

As will be described in detail later, the engaging arm 24 is formed as an "attachment state detection mechanism" that detects an attachment state of the connector housing 3 and the connector housing 3' (see FIG. 5).

Here, the engaging arm 24 serving as the "attachment state detection mechanism" will be described. As used herein, a state in the course of attachment of the connector housing 3 and the connector housing 3', in other words, a state in which the connector housing 3 and the connector housing 3' are incompletely attached to each other (see FIGS. 8 and 9), is referred to as an "incomplete attachment state." In the incomplete attachment state, the engaging arm 24 and the engaged arm 16 are in a state in the course of engagement. The engaging arm 24 has elasticity so as to be bendable toward an inside of the fitting chamber 12 in the incomplete attachment state, that is, in a state in which the engaging arm 24 and the engaged arm 16 are in the course of engagement (see FIGS. 8 and 9). When the counterpart connector 2 (the counterpart connector housing 4) is inserted into the fitting chamber 12 in the bent state, the engaging arm 24 comes into contact with a distal end surface 46 of the counterpart connector housing 4 so as to be able to restrict insertion up to a fitting completion position of the connector housing 3 and the counterpart connector housing 4. In other words, the engaging arm 24 in the bent state is configured to contact the distal end surface 46 of the counterpart connector housing 4 inserted into the fitting chamber 12 and restrict insertion of the counterpart connector housing 4 up to the fitting completion position.

More specifically, when the counterpart connector housing 4 is inserted into the fitting chamber 12 in the bent state, the engaging arm 24 can restrict the insertion of the counterpart connector housing 4 up to the fitting completion position by coming into contact with the distal end surface 46 of the counterpart connector housing 4 at an intermediate portion 49 in the extending direction (the front-rear direction) (see FIGS. 13 and 14). The intermediate portion 49 extends within any range between both ends of the engaging arm 24 in the front-rear direction, and the center of the intermediate portion 49 may coincide with, or may deviate from, the center of the engaging arm 24 in the front-rear direction.

As shown in FIG. 2, the engaging arm 24 is provided with an engaging protrusion 26 protruding downward at the intermediate portion 49 thereof in the extending direction. As shown in FIG. 3, the engaging protrusion 26 includes a tapered surface 27 and an engaging surface 28. The tapered surface 27 is formed so as to be gradually inclined downward from the rear end side toward the front end side of the bottom wall 8 (see FIG. 7). The engaging surface 28 is formed so as to be substantially orthogonal to the bottom wall 8 (see FIG. 7).

In the left side wall 9 shown in FIGS. 1 and 2, an engaging portion 30 is provided at an intermediate portion of a left side surface 29 in the upper-lower direction. As shown in FIGS. 1 and 2, the engaging portion 30 is formed so as to protrude leftward from the left side surface 29, and is formed so as to extend from a front end to a rear end of the left side surface 29 along the axial direction of the connector housing 3 (the front-rear direction in FIG. 1).

As shown in FIGS. 1 and 2, the engaging portion 30 includes a pair of wall portions 31, a pair of guide grooves 32 and an engaging protrusion 33. The wall portion 31, the guide groove 32 and the engaging protrusion 33 have configurations and structures substantially the same as those of the wall portion 22, the guide groove 23 and the engaging protrusion 26 in the bottom wall 8 described above, respectively. Therefore, in the present embodiment, detailed description of the wall portion 31, the guide groove 32 and the engaging protrusion 33 will be omitted.

The right side wall 10 shown in FIGS. 1 and 2 is provided with an engaged portion 35 at an intermediate portion of a right side surface 34 in the upper-lower direction. As shown in FIGS. 1 and 2, the engaged portion 35 is formed so as to protrude rightward from the right side surface 34, and is formed so as to extend from a front end to a rear end of the right side surface 34 along the axial direction of the connector housing 3 (the front-rear direction in FIG. 1).

As shown in FIGS. 1 and 2, the engaged portion 35 includes a pair of guide portions 36 and an engaged arm 37. The engaged arm 37 is provided with an engaged protrusion 38 at an intermediate portion thereof in an extending direction. The guide portion 36, the engaged arm 37 and the engaged protrusion 38 have configurations and structures substantially the same as those of the guide portion 15, the engaged arm 16 and the engaged protrusion 17 in the upper wall 7 described above, respectively. Therefore, in the present embodiment, detailed description of the guide portion 36, the engaged arm 37 and the engaged protrusion 38 will be omitted.

The insertion port 11 shown in FIGS. 1 and 2 is formed into the opening in the front surface of the connector housing 3. The insertion port 11 is formed such that the counterpart connector 2 (the counterpart connector housing 4) can be inserted (see FIG. 12).

The fitting chamber 12 shown in FIGS. 1 and 2 are formed inside the connector housing 3 so as to communicate with the insertion port 11. The fitting chamber 12 is formed as a portion that realizes fitting between the connector 1 (the connector housing 3) and the counterpart connector 2 (the counterpart connector housing 4) (see FIG. 12). The fitting chamber 12 is formed so as to be able to accommodating the counterpart connector 2 (the counterpart connector housing 4) (see FIG. 12).

As shown in FIG. 6, the fitting chamber 12 is provided with a locked protrusion 39 protruding toward the inside of the fitting chamber 12 on a front end side of an upper inner surface. The fitting chamber 12 is provided with guide grooves 40 at both ends of an upper side thereof in the left-right direction.

The terminal accommodating portion 6 shown in FIGS. 1 and 2 is formed continuously with a rear end of the connector fitting portion 5. The terminal accommodating portion 6 includes a plurality of terminal accommodating chambers 41 therein. Although detailed description of the terminal accommodating chamber 41 is omitted, the terminal accommodating chamber 41 is formed so as to be able to accommodate a terminal (not shown).

Next, the counterpart connector housing 4 will be described. The counterpart connector housing 4 shown in FIG. 4 is formed of an insulating synthetic resin material, and is formed in a block shape elongated in the left-right direction and extending in the front-rear direction. The counterpart connector housing 4 shown in FIG. 4 is formed so as to be inserted and accommodated in the fitting chamber 12 (see FIG. 12).

The counterpart connector housing 4 shown in FIG. 4 includes a plurality of terminal accommodating portions 42 therein. Although detailed description of the terminal accommodating chamber 42 is omitted, the terminal accommodating chamber 42 is formed so as to be able to accommodate a terminal (not shown). The counterpart connector housing 4 includes an engaging arm 44 and a pair of guide portions 45 on an upper surface 43 thereof.

The engaging arm 44 shown in FIG. 4 is provided at an intermediate portion of the upper surface 43 in the left-right direction. The engaging arm 44 is formed continuously with the upper surface 43 in an arm shape (a tongue shape). As shown in FIG. 4, the engaging arm 44 is formed so as to extend from a front end to a rear end of the upper surface 43 along an axial direction of the counterpart connector housing 4 (the front-rear direction in FIG. 4). The engaging arm 44 is provided with a lock protrusion 50.

As shown in FIG. 4, the pair of guide portions 45 are respectively provided at both ends of the upper surface 43 in the left-right direction. The guide portion 45 is formed so as to protrude upward, and is formed so as to extend from the front end to the rear end of the upper surface 43 along the axial direction of the counterpart connector housing 4 (the front-rear direction in FIG. 4). The guide portion 45 can be fitted to the guide groove 40 of the connector housing 3 (see FIGS. 1 and 2), and is formed slidably in the guide groove 40.

Next, work of assembling of the connector 1 (attachment of the connector housing 3 and the connector housing 3') will be described. First, as shown in FIG. 6, the guide portion 15 of the upper wall 7 of the connector housing 3' is inserted into the guide groove 23 of the bottom wall 8 of the connector housing 3 from a rear side, and the connector housing 3' slides in a direction indicated by an arrow D shown in FIG. 6. Thereafter, as shown in FIG. 7, the engaging protrusion 26 of the engaging arm 24 of the connector housing 3 and the engaged protrusion 17 of the engaged arm 16 of the connector housing 3' come into contact with each other. More specifically, the tapered surface 27 of the engaging protrusion 26 and the tapered surface 18 of the engaged protrusion 17 come into surface-contact with each other.

Thereafter, when the sliding of the connector housing 3' is continued, the tapered surface 27 of the engaging protrusion 26 and the tapered surface 18 of the engaged protrusion 17 come into sliding-contact with each other, and as shown in FIGS. 8 and 9, the engaging arm 24 is bent toward the inside of the fitting chamber 12. More specifically, as shown in FIG. 9, the engaging arm 24 is bent in a direction indicated by an arrow F around the intermediate portion 49. In this way, as the engaging arm 24 is bent toward the inside of the fitting chamber 12 (in other words, as part of the engaging arm 24 enters the fitting chamber 12), the engaging protrusion 26 is urged to get over the engaged protrusion 17. A state in which the engaging protrusion 26 is in a process of getting over the engaged protrusion 17 as shown in FIG. 9 can be said to be the "incomplete attachment state".

When the sliding of the connector housing 3' is further continued, as shown in FIG. 10, the engaging protrusion 26 completely gets over the engaged protrusion 17. Then, as shown in FIG. 9, the engaging arm 24 bent in the direction indicated by the arrow F around the intermediate portion 49 returns to a state before a start of being bent as shown in FIG. 10. When the engaging arm 24 returns to the state before the start of being bent, as shown in FIG. 11, the engaging surface 28 of the engaging protrusion 26 and the engaged surface 19 of the engaged protrusion 17 come into surface-contact with each other, and the engaging protrusion 26 and the engaged protrusion 17 are engaged with each other. Thus, the connector housing 3 and the connector housing 3' are attached, whereby the assembly of the connector 1 is completed.

Next, work of fitting the connector 1 (the connector housing 3) and the counterpart connector 2 (the counterpart connector housing 4) will be described. First, as shown in FIG. 10, the counterpart connector 2 (the counterpart connector housing 4) is inserted into the fitting chamber 12 of the connector housing 3 in a direction indicated by an arrow G. The counterpart connector 2 is inserted into the insertion port 11 of the connector housing 3 from the distal end surface 46 of the counterpart connector housing 4.

In FIG. 10, since the connector housing 3 and the connector housing 3' are in an appropriate attachment state, the engaging arm 24 of the connector housing 3 is not in a state of being bent around the intermediate portion 49 as shown in FIG. 9. Therefore, in FIG. 10, the insertion can be continued up to the fitting completion position of the connector housing 3 and the counterpart connector housing 4 without the distal end surface 46 of the counterpart connector housing 4 coming into contact with the engaging arm 24.

Continuing the insertion of the counterpart connector 2, as shown in FIG. 12, when the distal end surface 46 of the counterpart connector housing 4 reaches the deepest portion (the fitting completion position) of the fitting chamber 12, the lock protrusion 50 of the engaging arm 44 of the counterpart connector housing 4 and the locked protrusion 39 in the fitting chamber 12 are engaged with each other. Thus, fitting of the connector 1 (the connector housing 3) and the counterpart connector 2 (the counterpart connector housing 4) is completed.

Next, operation of the present embodiment when the connector 1 (the connector housing 3) and the counterpart connector 2 (the counterpart connector housing 4) are fitted to each other in the incomplete attachment state of the connector housing 3 and the connector housing 3' will be described.

As shown in FIG. 13, since the connector housing 3 and the connector housing 3' are in the incomplete attachment state, the engaging arm 24 of the connector housing 3 is in the state of being bent upward around the intermediate portion 49 as shown in FIG. 14.

In the bent state, when the counterpart connector 2 (the counterpart connector housing 4) is inserted into the fitting chamber 12 as shown in FIG. 13, the distal end surface 46 of the counterpart connector housing 4 comes into contact with the intermediate portion 49 of the engaging arm 24 as shown in FIG. 14. More specifically, a portion of the counterpart connector housing 4 on a side of the distal end surface 46 (specifically, an edge where the distal end surface 46 of the counterpart connector housing 4 and a lower surface of the counterpart connector housing 4 are continuous) interferes with the intermediate portion 49 of the bent engaging arm 24. According to the present embodiment, the distal end surface 46 of the counterpart connector housing 4 comes into contact with the intermediate portion 49 of the engaging arm 24, whereby the insertion of the counterpart connector housing 4 up to the fitting completion position of the connector housing 3 and the counterpart connector housing 4 is restricted.

In this way, according to the present embodiment, since the insertion of the counterpart connector housing 4 up to the fitting completion position is restricted, an operator can detect that the connector housing 3 and the connector housing 3' are in the incomplete attachment state.

Next, effects of the present embodiment will be described. As described above with reference to FIGS. 1 to 14, according to the present embodiment, the insertion of the counterpart connector housing 4 up to the fitting completion position of the connector housing 3 and the counterpart connector housing 4 is restricted even when the counterpart connector housing 4 is inserted into the fitting chamber 12 in the incomplete attachment state, so that it can be detected that the connector housing 3 and the connector housing 3' are in the incomplete attachment state. Therefore, according to the present embodiment, the incomplete attachment state when attaching the connector housings 3, 3' to each other can be prevented.

Second Embodiment

Next, the second embodiment will be described with reference to FIGS. 15 to 26.

Figure 15:
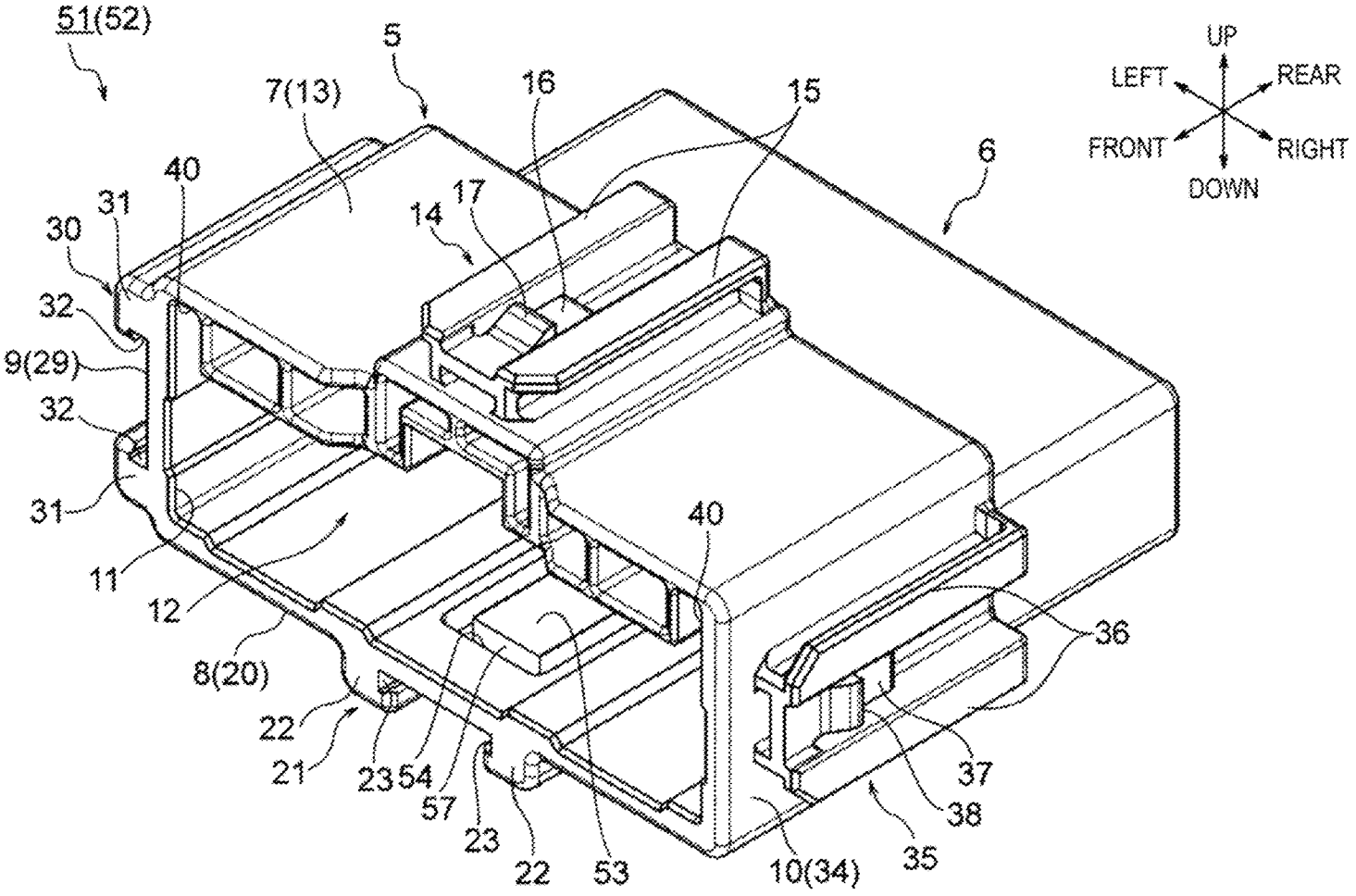
FIG. 15 is a perspective view showing a connector according to a second embodiment of the present disclosure.
Figure 16:
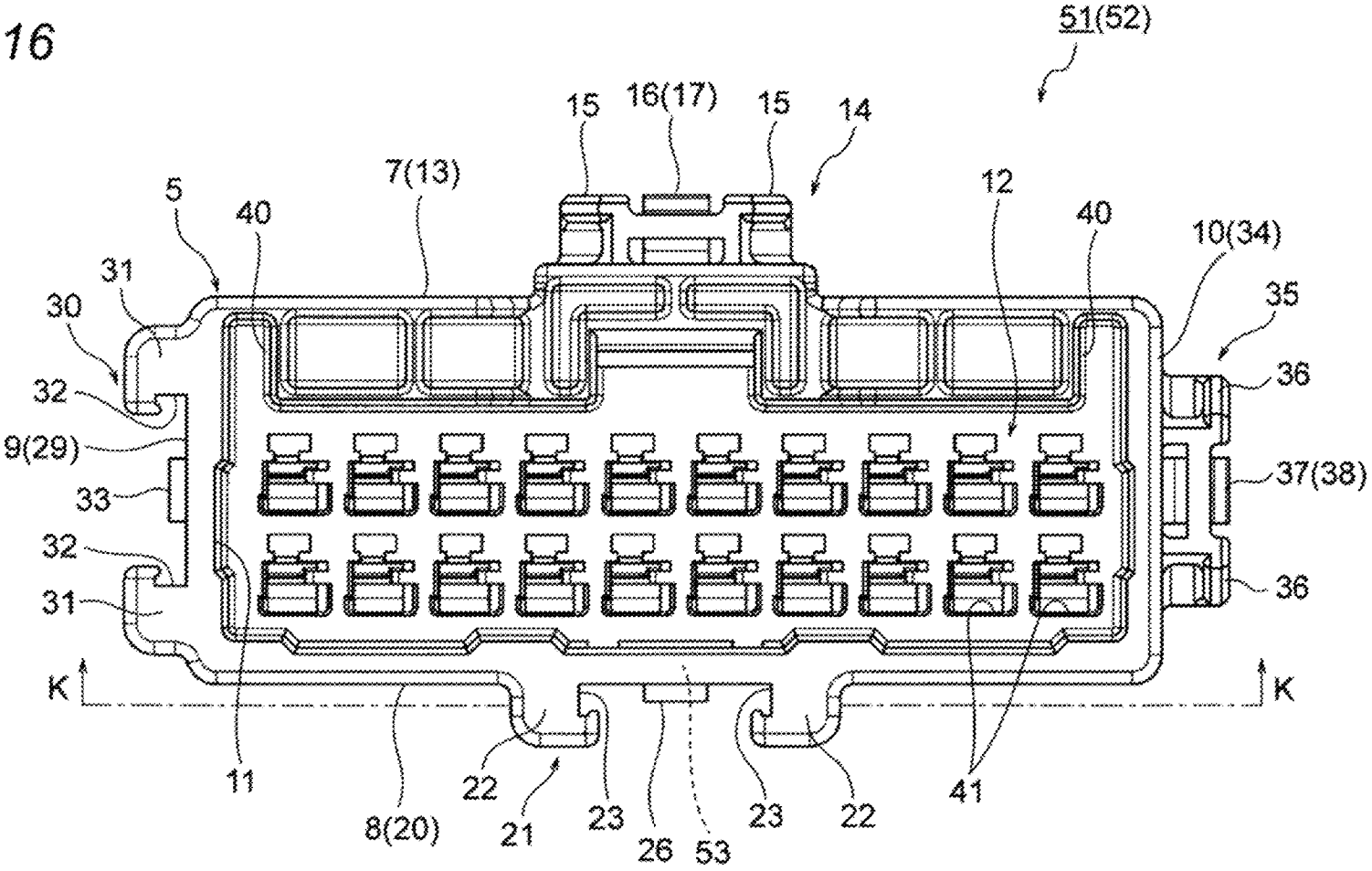
FIG. 16 is a front view of the connector (a connector housing) shown in FIG. 15.
Figure 17:
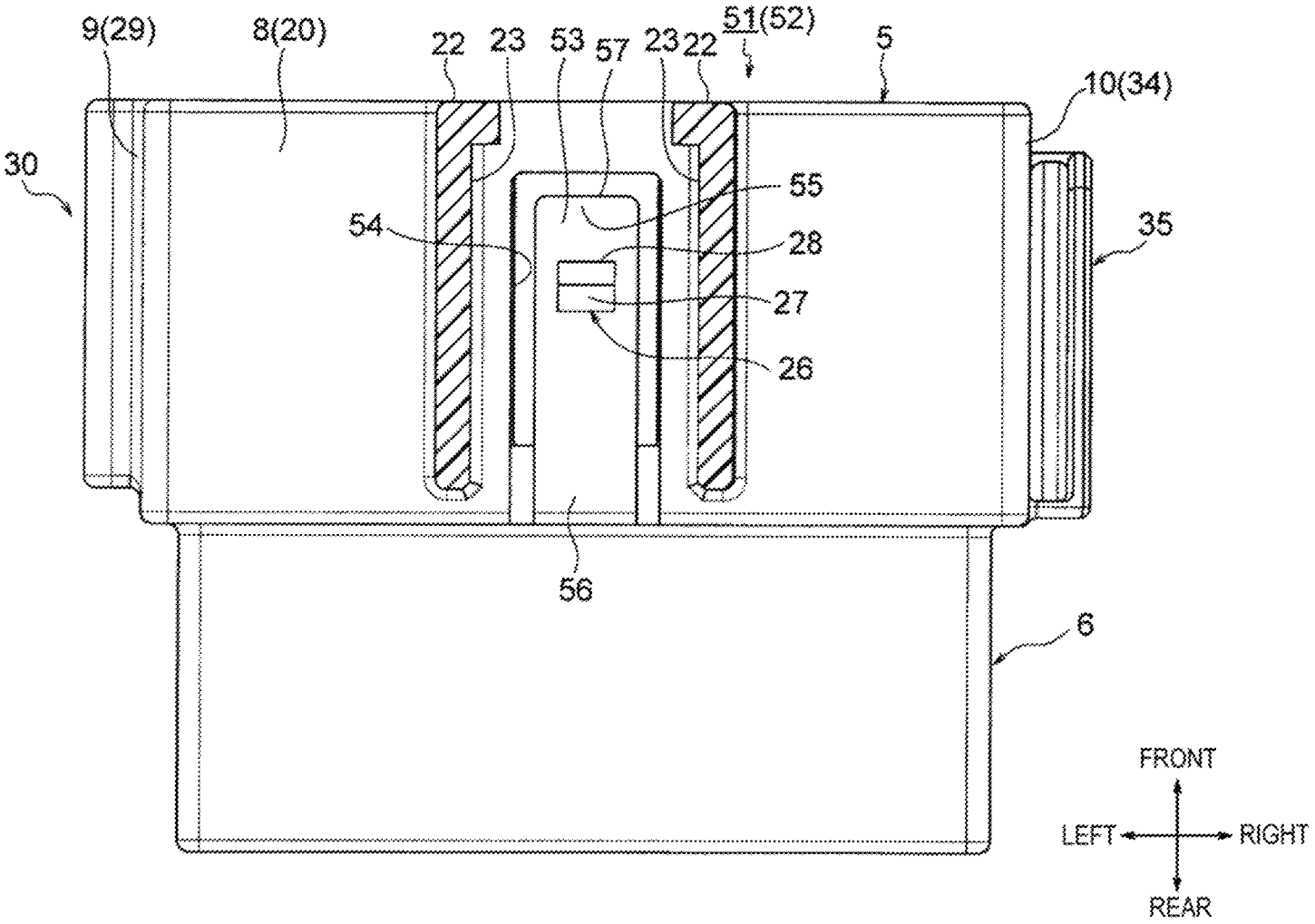
FIG. 17 is a plan view of the connector (the connector housing) in FIG. 16 as viewed from a lower surface side, and is a view taken along a line K-K in FIG. 16.
Figure 18:
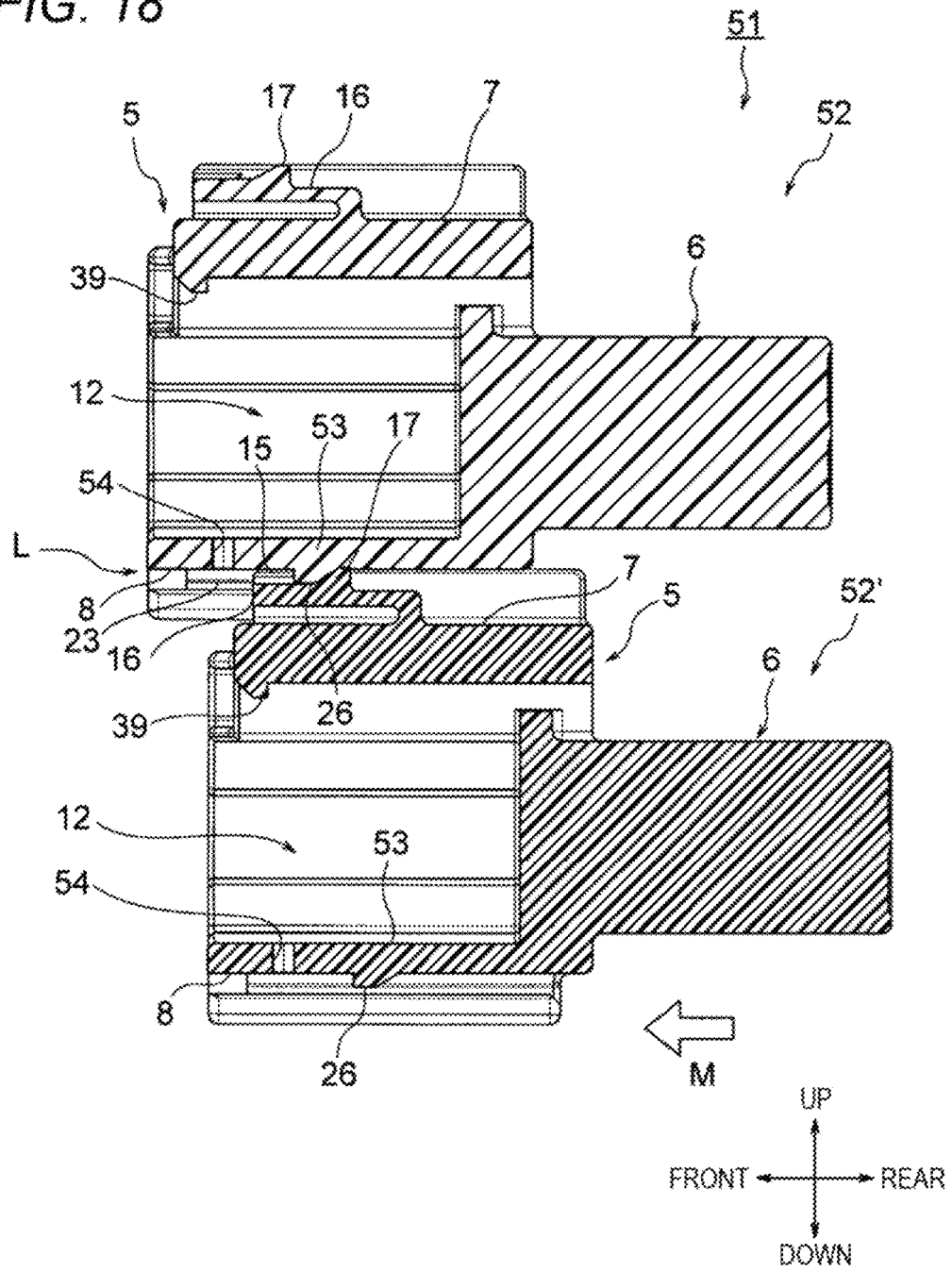
FIG. 18 is a cross-sectional view showing a state before the connector housings are attached to each other and before one connector housing and the counterpart connector housing are fitted to each other as taken along a position the same as the line B-B in FIG. 5.
Figure 19:
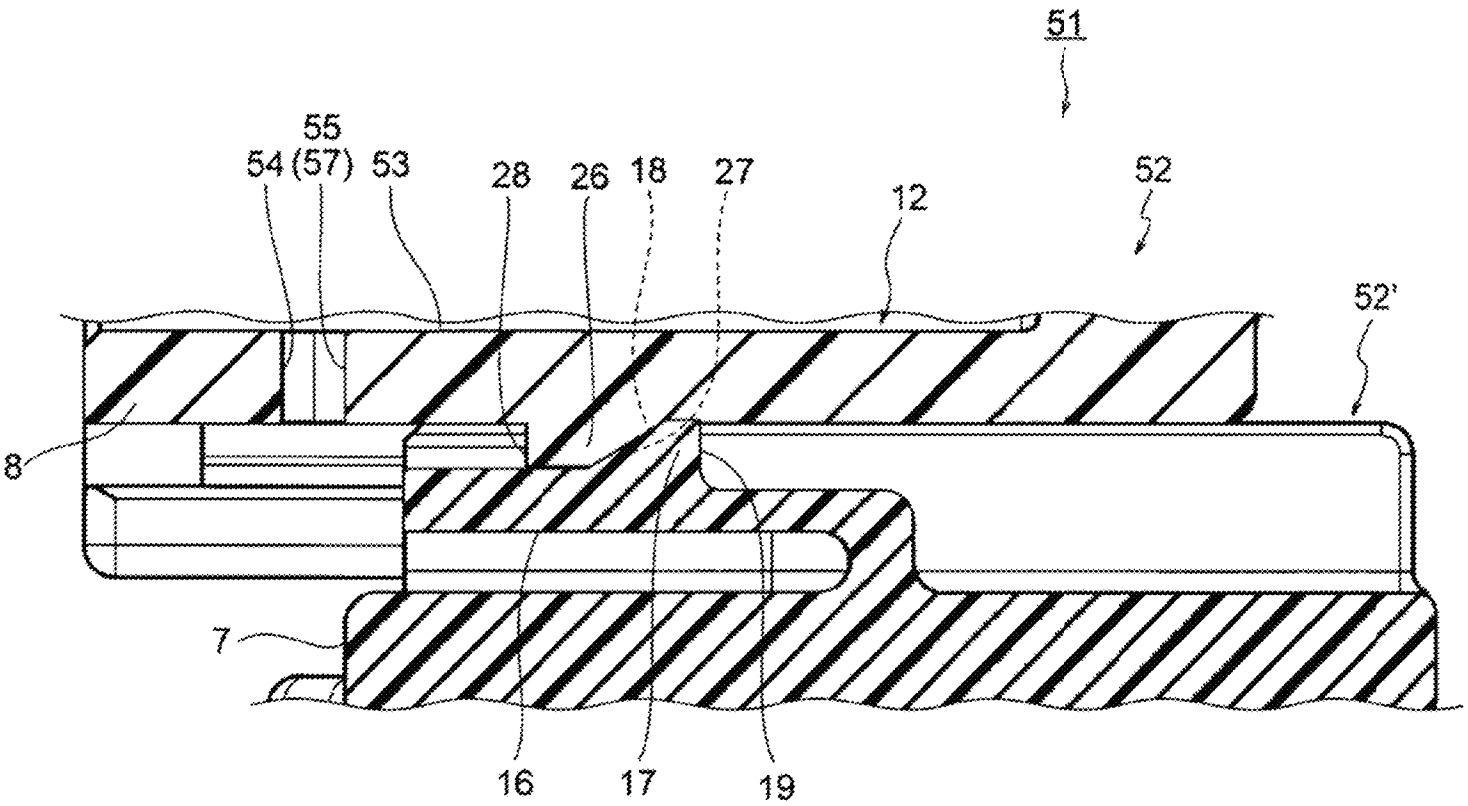
FIG. 19 is an enlarged cross-sectional view of a portion indicated by an arrow L in FIG. 18.
Figure 20:
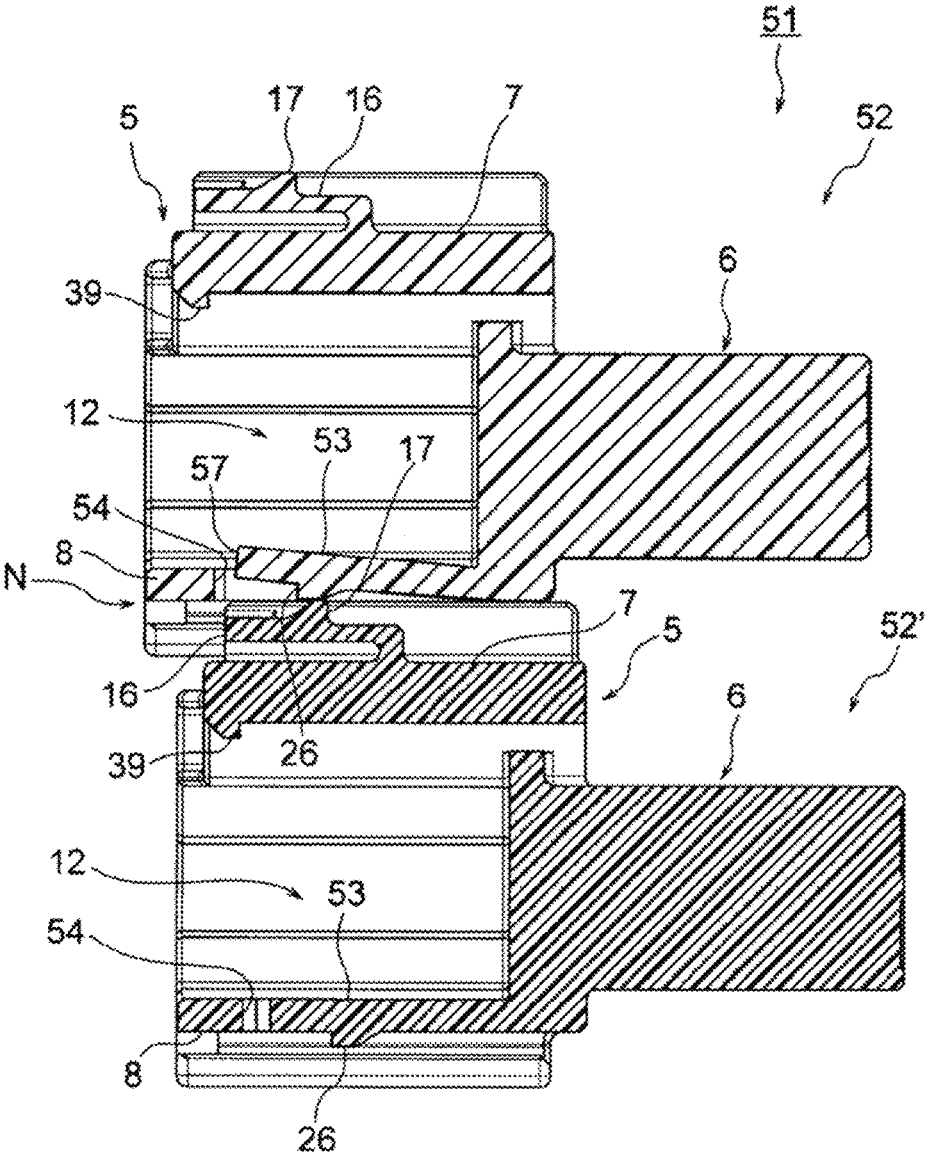
FIG. 20 is a view following FIG. 18, and is a cross-sectional view showing an incomplete attachment state of the connector housings.
Figure 21:
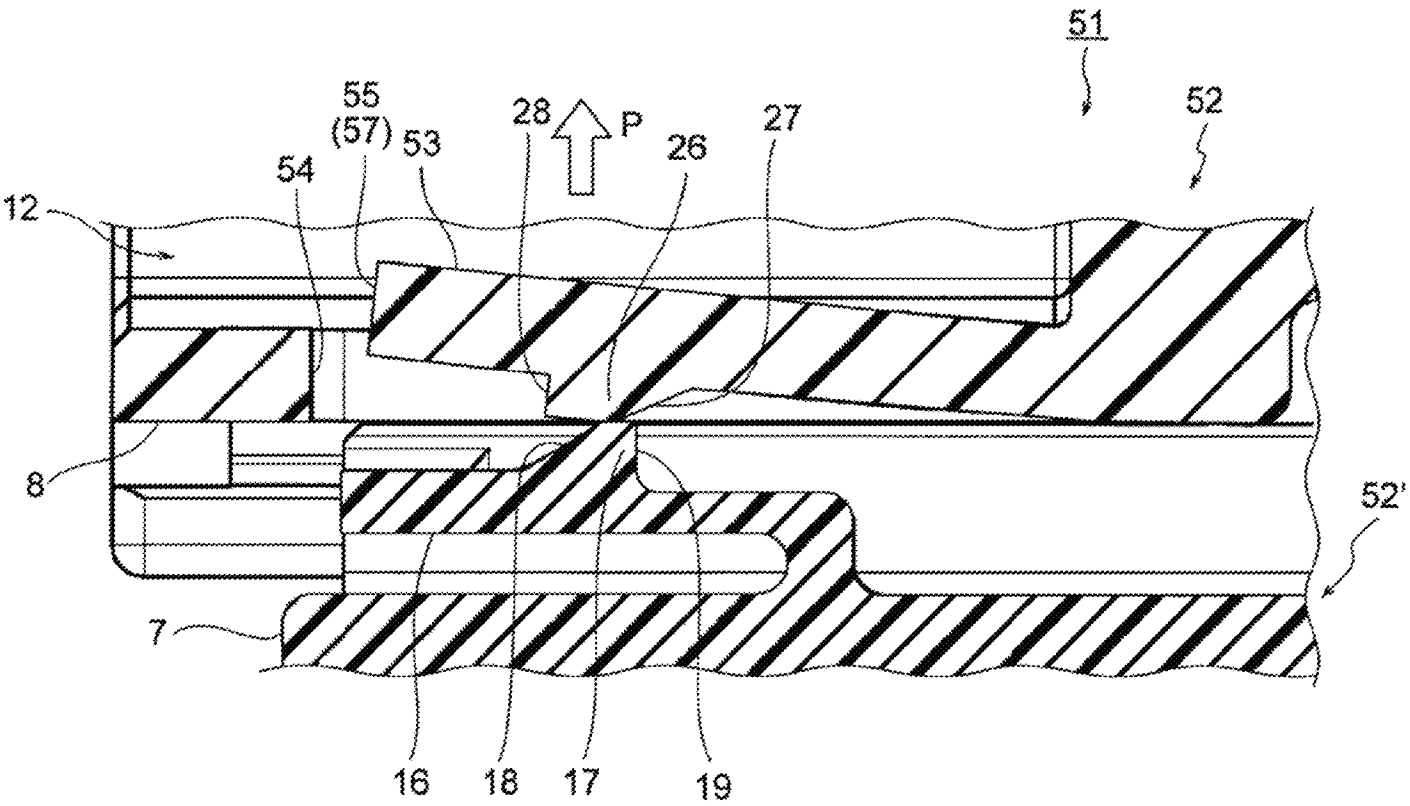
FIG. 21 is an enlarged cross-sectional view of a portion indicated by an arrow N in FIG. 20.
Figure 22:
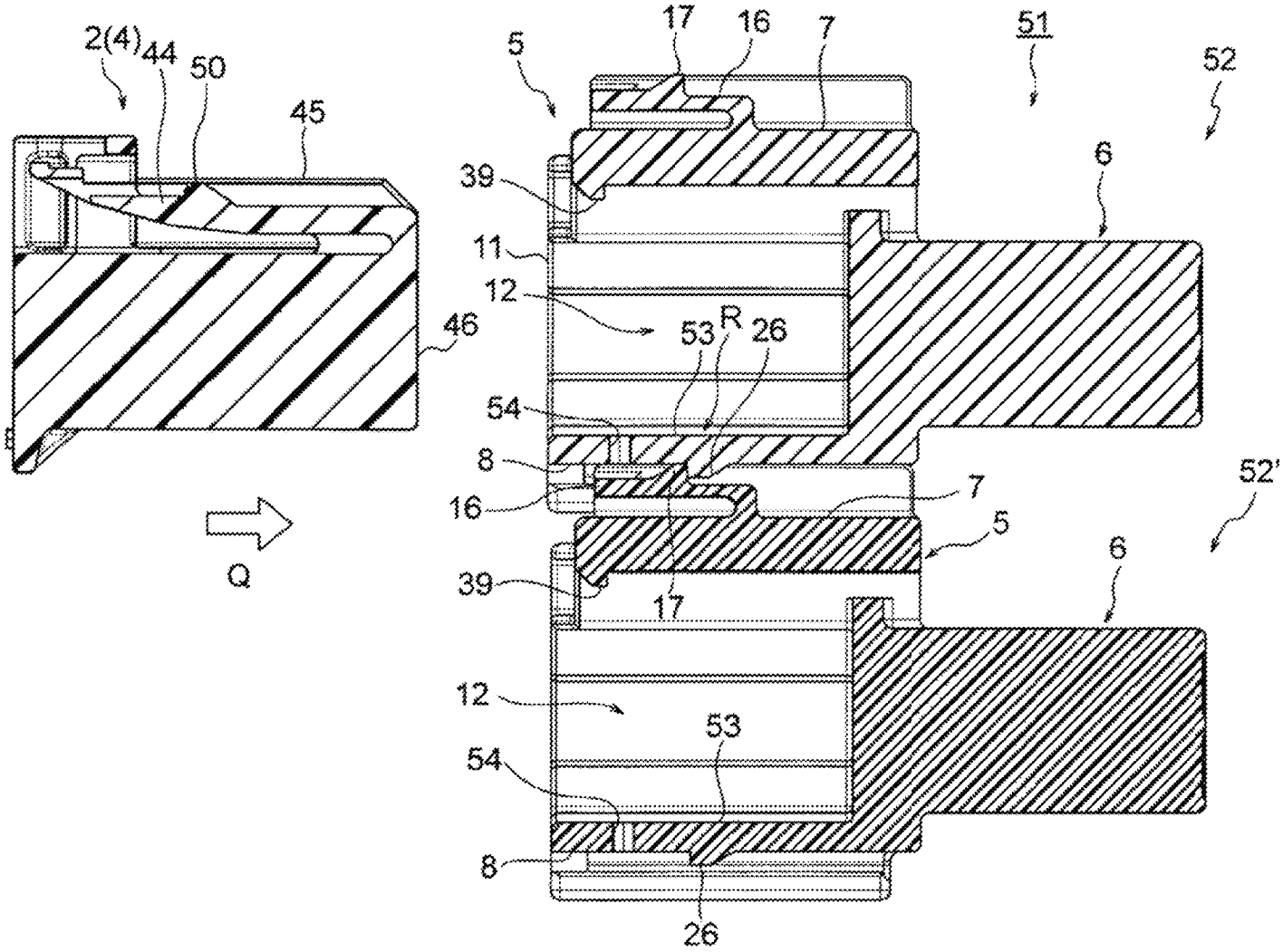
FIG. 22 is a view following FIG. 20, and is a cross-sectional view showing a state in which the connector housings are attached to each other, and a cross-sectional view of the counterpart connector housing.
Figure 23:
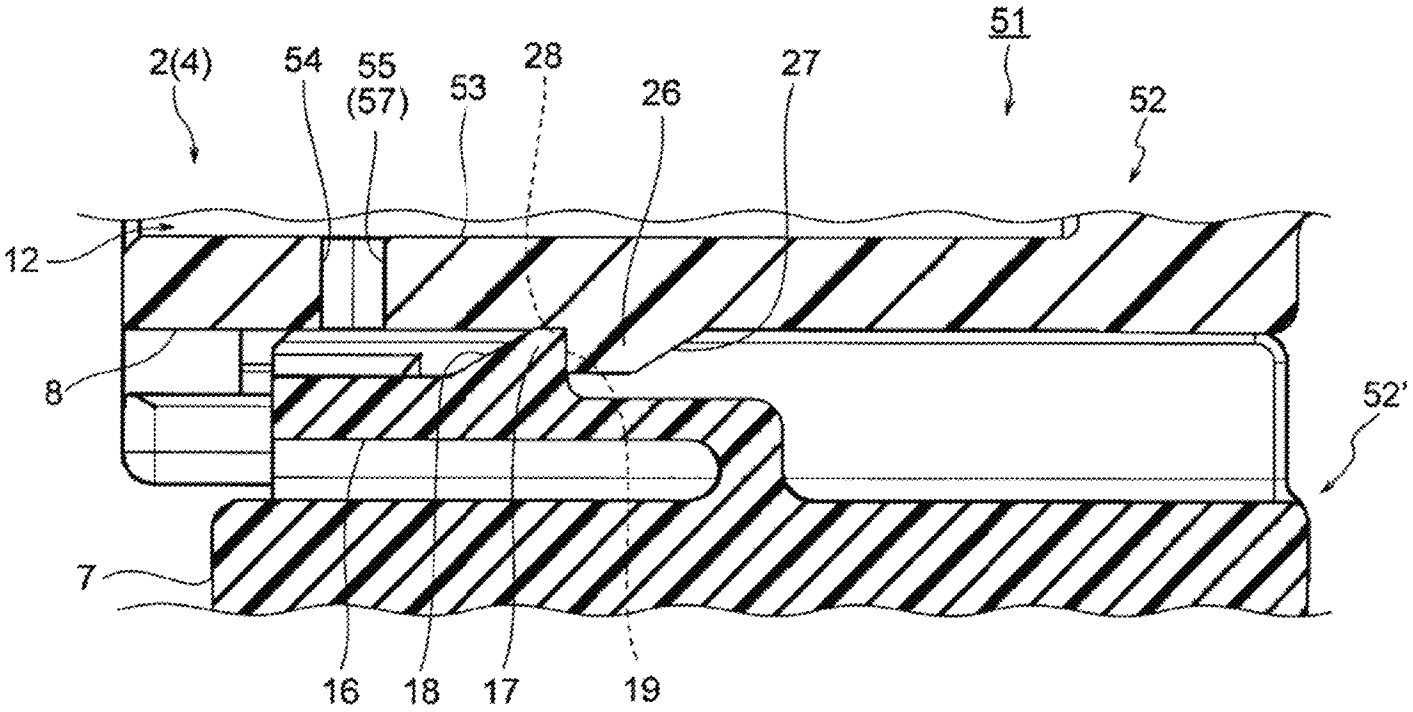
FIG. 23 is an enlarged cross-sectional view of a portion indicated by an arrow R in FIG. 22.
Figure 24:
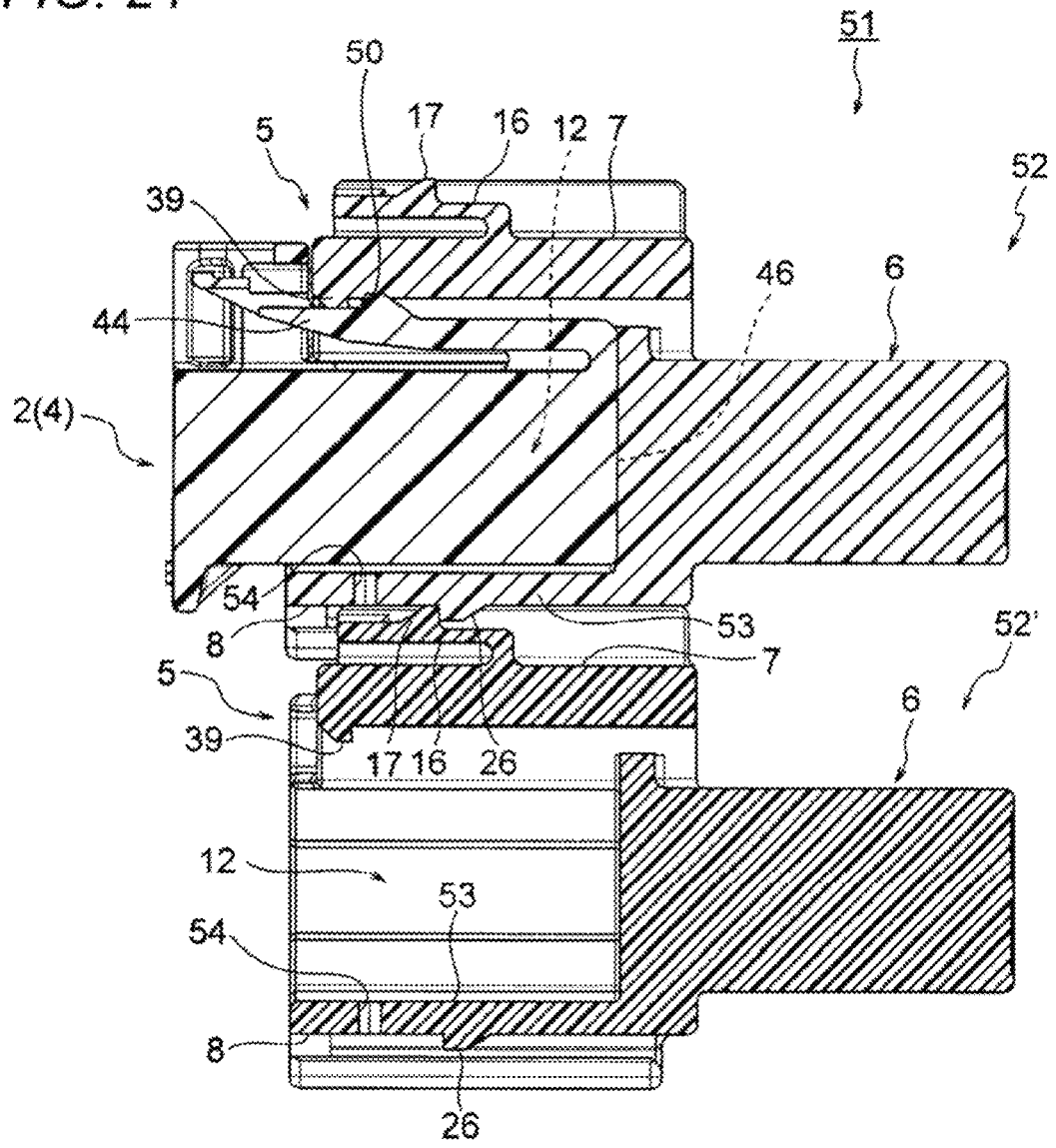
FIG. 24 is a view following FIG. 22, and is a cross-sectional view showing a state in which one connector housing and the counterpart connector housing are fitted to each other in the state in which the connector housings are attached to each other.
Figure 25:
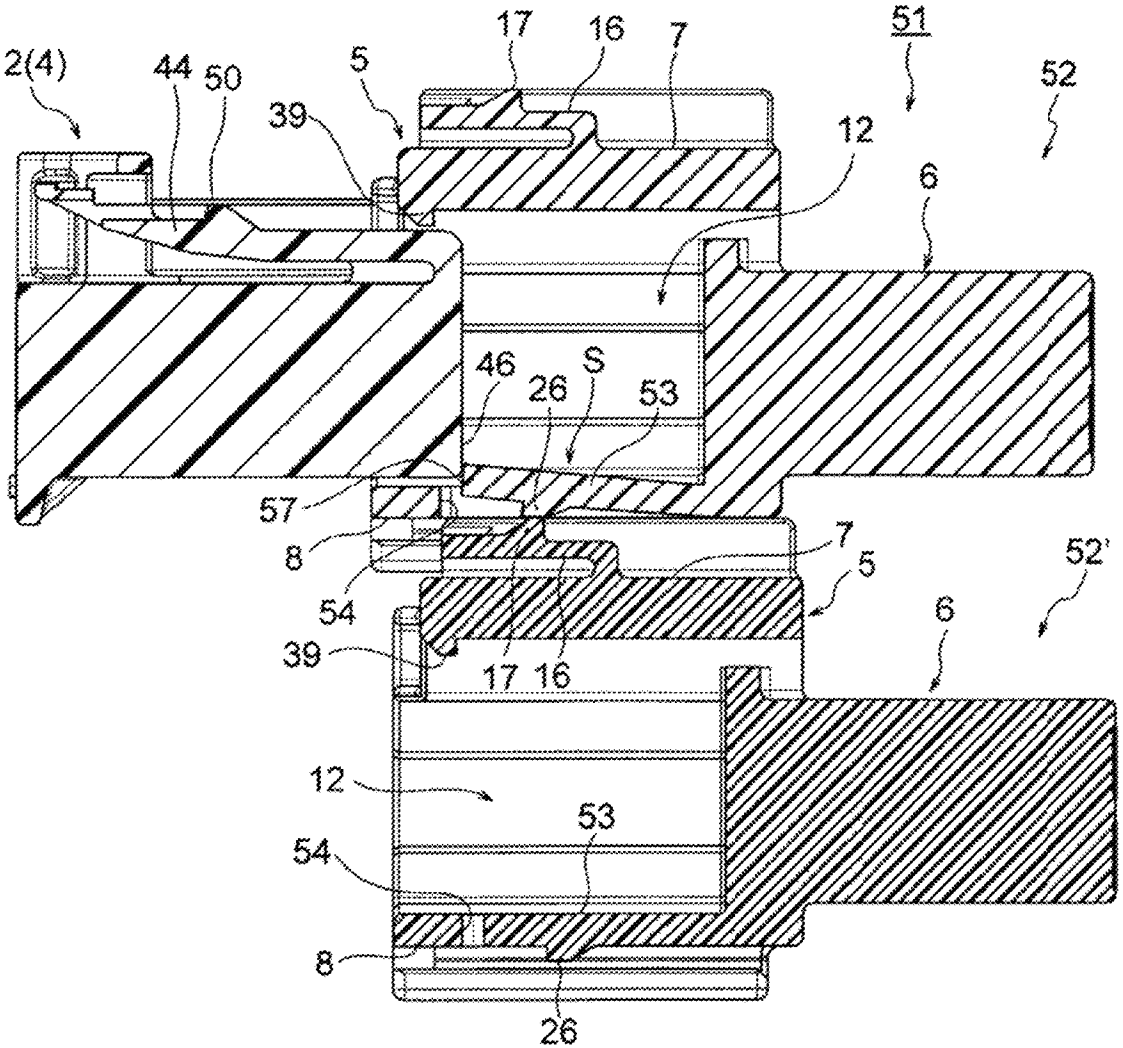
FIG. 25 is a cross-sectional view showing a state in which the counterpart connector housing is started to be inserted into a fitting chamber of one connector housing in the incomplete attachment state of the connector housings.
Figure 26:
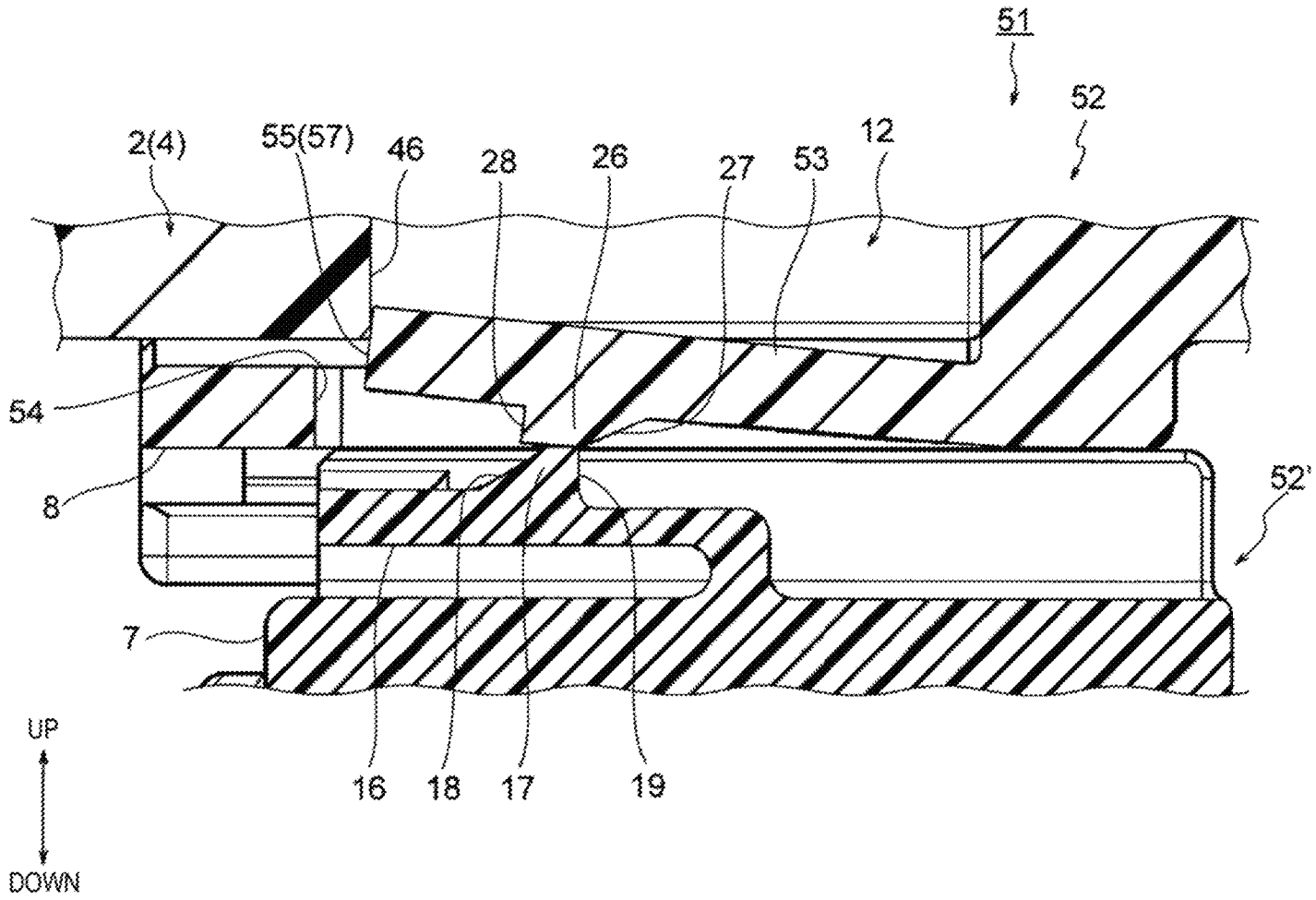
FIG. 26 is an enlarged cross-sectional view of a portion indicated by an arrow S in FIG. 25.

FIG. 15 is a perspective view showing a connector according to the second embodiment of the present disclosure; FIG. 16 is a front view of the connector (a connector housing) shown in FIG. 15; FIG. 17 is a plan view of the connector (the connector housing) in FIG. 16 as viewed from a lower surface side, and is a view taken along a line K-K in FIG. 16; FIG. 18 is a cross-sectional view showing a state before the connector housings are attached to each other and before one connector housing and the counterpart connector housing are fitted to each other as taken along a position the same as the line B-B in FIG. 5; FIG. 19 is an enlarged cross-sectional view of a portion indicated by an arrow L in FIG. 18; FIG. 20 is a view following FIG. 18, and is a cross-sectional view showing an incomplete attachment state of the connector housings; FIG. 21 is an enlarged cross-sectional view of a portion indicated by an arrow N in FIG. 20; FIG. 22 is a view following FIG. 20, and is a cross-sectional view showing a state in which the connector housings are attached to each other, and a cross-sectional view of the counterpart connector housing; FIG. 23 is an enlarged cross-sectional view of a portion indicated by an arrow R in FIG. 22; FIG. 24 is a view following FIG. 22, and is a cross-sectional view showing a state in which one connector housing and the counterpart connector housing are fitted to each other in the state in which the connector housings are attached to each other; FIG. 25 is a cross-sectional view showing a state in which the counterpart connector housing is started to be inserted into a fitting chamber of one connector housing in the incomplete attachment state of the connector housings; and FIG. 26 is an enlarged cross-sectional view of a portion indicated by an arrow S in FIG. 25. Arrows in the drawings respectively indicate a front-rear direction, an upper-lower direction and a left-right direction (directions of the arrows are examples). The same components as those of the first embodiment are denoted by the same reference numerals, and detailed description thereof is omitted.

In FIGS. 15 to 17, a reference numeral 51 indicates a connector according to the embodiment of the present disclosure. Similarly to the connector 1 in the first embodiment (see FIG. 5), the connector 51 is used in a state in which a connector housing 52 and a connector housing 52' are stacked and attached to each other (see FIG. 22). In the present embodiment, the two connector housings are used in a state of being stacked and attached to each other, but the present disclosure is not limited to this, and three or more connector housings may be used in a state of being stacked and attached to each other as in the first embodiment.

Here, the connector housing 52 serves as an example of a "first connector housing." The connector housing 52' serves as an example of a "second connector housing."

The connector 51 includes the connector housing 52 (see FIGS. 15 to 17), the connector housing 52' (see FIG. 18) and a terminal-attached electric wire (not shown). The connector housing 52 and the connector housing 52' have the same configuration and structure. Therefore, in the present embodiment, detailed description of the connector housing 52' will be omitted. Hereinafter, the configuration of the connector housing 52 will be described.

The connector housing 52 shown in FIGS. 15 to 17 is different from that in the first embodiment in that an engaging arm 53 is provided instead of the engaging arm 24 in the first embodiment (see FIGS. 1 and 3). Hereinafter, the engaging arm 53 will be described.

As shown in FIGS. 15 and 17, the engaging arm 53 is formed in an arm shape (a tongue shape). As shown in FIG. 17, the engaging arm 53 is formed between the pair of wall portions 22 and extends from a front end side to a rear end side of the bottom wall 8 along an axial direction of the connector housing 52 (the front-rear direction in FIG. 17).

More specifically, as shown in FIG. 17, the engaging arm 53 is formed by providing a slit 54 in the bottom wall 8. The slit 54 is formed between the pair of wall portions 22 to be notched in a substantially U shape from the front end side to the rear end side of the bottom wall 8. As shown in FIG. 17, the engaging arm 53 is integrally formed with the bottom wall 8, and one end 55 (an example of a "first end") thereof in an extending direction is separated from the bottom wall 8 to serve as an open end, and the other end 56 (an example of a "second end") is formed continuously with the bottom wall 8. That is, the engaging arm 53 is provided in the bottom wall 8 in a cantilever shape.

As will be described in detail later, similarly to the engaging arm 24 in the first embodiment, the engaging arm 53 is formed as an "attachment state detection mechanism" that detects an attachment state of the connector housing 52 and the connector housing 52' (see FIG. 18).

Here, the engaging arm 53 serving as the "attachment state detection mechanism" will be described. The engaging arm 53 has elasticity so as to be bendable toward an inside of the fitting chamber 12 (see FIGS. 20 and 21) in a state in which the engaging arm 53 and the engaged arm 16 are in the course of engagement (that is, the incomplete attachment state, see FIGS. 20 and 21). When the counterpart connector 2 (the counterpart connector housing 4) is inserted into the fitting chamber 12 in the bent state, the engaging arm 53 comes into contact with the distal end surface 46 of the counterpart connector housing 4 so as to be able to restrict insertion up to a fitting completion position of the connector housing 52 and the counterpart connector housing 4. In other words, the engaging arm 53 in the bent state is configured to contact a distal end surface 46 of the counterpart connector housing 4 inserted into the fitting chamber 12 and restrict insertion of the counterpart connector housing 4 up to the fitting completion position.

More specifically, when the counterpart connector housing 4 is inserted into the fitting chamber 12 in the bent state, the engaging arm 53 can restrict the insertion of the counterpart connector housing 4 up to the fitting completion position by coming into contact with the distal end surface 46 of the counterpart connector housing 4 at an end surface 57 of one end 55 (see FIGS. 25 and 26).

Next, work of assembling the connector 51 (attachment of the connector housing 52 and the connector housing 52') will be described. First, as shown in FIG. 18, the guide portion 15 of the upper wall 7 of the connector housing 52' is inserted into the guide groove 23 of the bottom wall 8 of the connector housing 52 from a rear side, and the connector housing 52' slides in a direction indicated by an arrow M shown in FIG. 18. Thereafter, as shown in FIG. 18, the engaging protrusion 26 of the engaging arm 53 of the connector housing 52 and the engaged protrusion 17 of the engaged arm 16 of the connector housing 3' come into contact with each other. More specifically, the tapered surface 27 of the engaging protrusion 26 and the tapered surface 18 of the engaged protrusion 17 come into surface-contact with each other.

Thereafter, when the sliding of the connector housing 52' is continued, the tapered surface 27 of the engaging protrusion 26 and the tapered surface 18 of the engaged protrusion 17 come into sliding-contact with each other, and as shown in FIGS. 20 and 21, the engaging arm 53 is bent toward the inside of the fitting chamber 12. More specifically, as shown FIG. 21, the engaging arm 53 is bent in a direction indicated by an arrow P on a side of one end 55. In this way, as the engaging arm 53 is bent toward the inside of the fitting chamber 12 (in other words, as part of the engaging arm 53 enters the fitting chamber 12), the engaging protrusion 26 is urged to get over the engaged protrusion 17. A state in which the engaging protrusion 26 is in a process of getting over the engaged protrusion 17 as shown in FIG. 21 can be said to be the "incomplete attachment state".

When the sliding of the connector housing 52' is further continued, as shown in FIG. 22, the engaging protrusion 26 completely gets over the engaged protrusion 17. Then, as shown in FIG. 21, the engaging arm 53 bent in the direction indicated by the arrow P on side of one end 55 returns to a state before a start of being bent as shown in FIG. 22. When the engaging arm 53 returns to the state before the start of being bent, as shown in FIG. 23, the engaging surface 28 of the engaging protrusion 26 and the engaged surface 19 of the engaged protrusion 17 come into surface-contact with each other, and the engaging protrusion 26 and the engaged protrusion 17 are engaged with each other. Thus, the connector housing 52 and the connector housing 52' are attached, whereby the assembly of the connector 51 is completed.

Next, work of fitting the connector 51 (the connector housing 52) and the counterpart connector 2 (the counterpart connector housing 4) will be described. First, as shown in FIG. 22, the counterpart connector 2 (the counterpart connector housing 4) is inserted into the fitting chamber 12 of the connector housing 52 in a direction indicated by an arrow Q. The counterpart connector 2 is inserted into the insertion port 11 of the connector housing 52 from the distal end surface 46 of the counterpart connector housing 4.

In FIG. 22, since the connector housing 52 and the connector housing 52' are in an appropriate attachment state, the engaging arm 53 of the connector housing 52 is not in a state of being bent on the side of one end 55 as shown in FIG. 21. Therefore, in FIG. 22, the insertion can be continued up to the fitting completion position of the connector housing 52 and the counterpart connector housing 4 without the distal end surface 46 of the counterpart connector housing 4 coming into contact with the engaging arm 53.

Continuing the insertion of the counterpart connector 2, when the distal end surface 46 of the counterpart connector housing 4 reaches the deepest portion (the fitting completion position) of the fitting chamber 12, the lock protrusion 50 of the engaging arm 44 of the counterpart connector housing 4 and the locked protrusion 39 in the fitting chamber 12 are engaged with each other. Thus, fitting of the connector 51 (the connector housing 52) and the counterpart connector 2 (the counterpart connector housing 4) is completed.

Next, operation of the present embodiment when the connector 51 (the connector housing 52) and the counterpart connector 2 (the counterpart connector housing 4) are fitted to each other in the incomplete attachment state of the connector housing 52 and the connector housing 52' will be described.

As shown in FIG. 25, since the connector housing 52 and the connector housing 52' are in the incomplete attachment state, the engaging arm 53 of the connector housing 52 is in the state of being bent upward on the side of one end 55 as shown in FIG. 26.

In the bent state, when the counterpart connector 2 (the counterpart connector housing 4) is inserted into the fitting chamber 12 as shown in FIG. 25, the distal end surface 46 of the counterpart connector housing 4 comes into contact with the end surface 57 of one end 55 of the engaging arm 53 as shown in FIG. 26.

According to the present embodiment, since the distal end surface 46 of the counterpart connector housing 4 comes into contact with the end surface 57 of one end 55 of the engaging arm 53, the insertion of the counterpart connector housing 4 up to the fitting completion position of the connector housing 52 and the counterpart connector housing 4 is restricted more reliably than in the first embodiment (the insertion of the counterpart connector housing 4 up to the fitting completion position in the incomplete attachment state is of course restricted in the first embodiment). Therefore, according to the present embodiment, accuracy of detecting that the connector housing 52 and the connector housing 52' are in the incomplete attachment state is improved higher than that of the first embodiment (accuracy of detecting the incomplete attachment state is of course high). In this way, according to the present embodiment, since the accuracy of detecting that the connector housings 52, 52' are in the incomplete attachment state is improved, the connector housing 52 and the counterpart connector housing 4 may not be forcibly fitted to each other in the incomplete attachment state.

Next, effects of the present embodiment will be described. As described above with reference to FIGS. 15 to 26, according to the present embodiment, the same effects as those of the first embodiment are achieved.

It is needless to say that various modifications of the present disclosure can be made without departing from the scope of the present invention.

In the above description, the connector 1 (the connector housing 3) in the first embodiment and the connector 51 (the connector housing 52) in the second embodiment are each provided with an engaging arm serving as the "attachment state detection mechanism" at the bottom wall 8 of the connector fitting portion 5, but the present disclosure is not limited thereto, and the following configuration may be used.

That is, although not particularly shown, the connector (the connector housing) according to the present disclosure may be provided with an engaging arm (the attachment state detection mechanism) having the same configuration and structure as the engaging arm 24 in the first embodiment or the engaging arm 53 in the second embodiment at an intermediate portion of the left side wall 9 in the upper-lower direction.

Although not particularly shown, the counterpart connector housing 4 is fitted into the fitting chamber 12 of the connector housing 3' in the first embodiment or the fitting chamber 12 of the connector housing 52' in the second embodiment.

According to the embodiments described above, the following configurations and advantages can be provided.

(1) A connector including: a first connector housing including a first wall, the first connector housing being attachable to a second connector housing such that the first wall opposes a second wall of the second connector housing, wherein the first connector housing includes: a fitting chamber defined at least by the first wall, the fitting chamber allowing a counterpart connector housing to be fitted therein; and an engaging arm provided on the first wall, the engaging arm being configured to engage an engaged arm provided on the second surface of the second connector housing when the first connector housing is completely attached to the second connector housing, and wherein the engaging arm serves as an attachment state detection mechanism configured to detect an incomplete attachment state in which the first connector housing is incompletely attached to the second connector housing.

According to the above item (1), since the engaging arm is formed as the attachment state detection mechanism, the incomplete attachment state of the connector housings can be detected.

(2) The connector according to the above item (1), wherein the engaging arm has elasticity so as to be bent toward an inside of the fitting chamber in the incomplete attachment state, and wherein the engaging arm in a bent state is configured to contact a distal end surface of the counterpart connector housing inserted into the fitting chamber and restrict insertion of the counterpart connector housing up to a fitting completion position.

According to the above item (2), the engaging arm is bent toward the inside of the fitting chamber in the incomplete attachment state, and when the counterpart connector housing is inserted into the fitting chamber in the bent state, the distal end surface of the counterpart connector housing comes into contact with the engaging arm, whereby the insertion of the counterpart connector housing up to the fitting completion position of the connector housing and the counterpart connector housing is restricted.

(3) The connector according to the above item (2), wherein the engaging arm is integrally formed with the first wall so as to extend from a first end to a second end along an axial direction of the first connector housing, wherein each of the first end and the second end of the engaging arm is continuous with the first wall, and wherein the engaging arm in the bent state is configured to contact the distal end surface of the counterpart connector housing at an intermediate portion of the engaging arm in the axial direction.

According to the present disclosure having the above item (3), the engaging arm is bent toward the inside of the fitting chamber in the incomplete attachment state, and when the counterpart connector housing is inserted into the fitting chamber in the bent state, the distal end surface of the counterpart connector housing comes into contact with the intermediate portion of the engaging arm, whereby the insertion of the counterpart connector housing up to the fitting completion position of the connector housing and the counterpart connector housing is restricted.

(4) The connector according to the above item (2), wherein the engaging arm is integrally formed with the first wall so as to extend from a first end to a second end along an axial direction of the first connector housing, wherein the first end of the engaging arm is separated from the first wall to serve as an open end, and the second end of the engaging arm is continuous with the first wall, and wherein the engaging arm in the bent state is configured to contact the distal end surface of the counterpart connector housing at an end surface of the first end.

According to the present disclosure having the above item (4), the engaging arm is bent toward the inside of the fitting chamber in the incomplete attachment state, and when the counterpart connector housing is inserted into the fitting chamber in the bent state, the distal end surface of the counterpart connector housing comes into contact with the end surface of one end of the engaging arm, whereby the insertion of the counterpart connector housing up to the fitting completion position of the connector housing and the counterpart connector housing is more reliably restricted. Therefore, accuracy of detection of the incomplete attachment state of the connector housings can be improved. In this way, since the accuracy of detection of the connector housings are in the incomplete attachment state is improved, the connector housing and the counterpart connector housing may not be forcibly fitted to each other in the incomplete attachment state.

The invention claimed is:

1. A connector comprising:

a first connector housing comprising a first wall, the first connector housing being attachable to a second connector housing such that the first wall opposes a second wall of the second connector housing, wherein the first connector housing comprises:

a fitting chamber defined at least by the first wall, the fitting chamber allowing a counterpart connector housing to be fitted therein; and an engaging arm provided on the first wall, the engaging arm being configured to engage an engaged arm provided on the second surface of the second connector housing when the first connector housing is completely attached to the second connector housing, and wherein the engaging arm serves as an attachment state detection mechanism, configured to detect an incomplete attachment state in which the first connector housing is incompletely attached to the second connector housing, by at least being configured to contact a surface of and restrict an insertion of the counterpart connector housing up to a fitting completion position.

2. The connector according to claim 1, wherein the engaging arm has elasticity so as to be bent toward an inside of the fitting chamber in the incomplete attachment state, wherein the surface of the counterpart connector housing is a distal end surface of the counterpart connector housing, and wherein the engaging arm in a bent state is configured to contact the distal end surface of the counterpart connector housing inserted into the fitting chamber and restrict the insertion of the counterpart connector housing up to the fitting completion position.

3. The connector according to claim 2, wherein the engaging arm is integrally formed with the first wall so as to extend from a first end to a second end along an axial direction of the first connector housing, wherein each of the first end and the second end of the engaging arm is continuous with the first wall, and wherein the engaging arm in the bent state is configured to contact the distal end surface of the counterpart connector housing at an intermediate portion of the engaging arm in the axial direction.

4. The connector according to claim 2, wherein the engaging arm is integrally formed with the first wall so as to extend from a first end to a second end along an axial direction of the first connector housing, wherein the first end of the engaging arm is separated from the first wall to serve as an open end, and the second end of the engaging arm is continuous with the first wall, and wherein the engaging arm in the bent state is configured to contact the distal end surface of the counterpart connector housing at an end surface of the first end.

5. A connector comprising:

a first connector housing comprising a first wall, the first connector housing being attachable to a second connector housing such that the first wall opposes a second wall of the second connector housing, wherein the first connector housing comprises:

a fitting chamber defined at least by the first wall, the fitting chamber allowing a counterpart connector housing to be fitted therein; and an engaging arm provided on the first wall, the engaging arm being configured to engage an engaged arm provided on the second surface of the second connector housing when the first connector housing is completely attached to the second connector housing, and wherein the engaging arm serves as an attachment state detection mechanism configured to detect an incomplete attachment state in which the first connector housing is incompletely attached to the second connector housing, wherein the engaging arm has elasticity so as to be bent toward an inside of the fitting chamber in the incomplete attachment state, and wherein the engaging arm in a bent state is configured to contact a distal end surface of the counterpart connector housing inserted into the fitting chamber and restrict insertion of the counterpart connector housing up to a fitting completion position.

* * * * *